United States Patent [19]

Bolton et al.

[11] 4,091,910

[45] May 30, 1978

[54] METHOD AND APPARATUS FOR EMBOSSING CARDS AND SHEETS

[75] Inventors: Edgar A. Bolton, Tarzana; Gust A. Olson, Los Angeles, both of Calif.

[73] Assignee: Jacquard Systems, Santa Monica, Calif.

[21] Appl. No.: 641,008

[22] Filed: Dec. 15, 1975

Related U.S. Application Data

[63] Continuation-in-part of Ser. No. 532,252, Dec. 12, 1974, abandoned.

[51] Int. Cl.[2] ..... B41J 1/30

[52] U.S. Cl. ..... 400/131; 101/91; 101/32; 101/18; 400/134.2

[58] Field of Search ..... 197/6, 6.2, 6.3, 6.4, 197/6.5, 6.6, 6.7; 101/6, 19–22, 29, 32, 23, 18, 90–92, 93.29, 426, 93.01

[56] References Cited

U.S. PATENT DOCUMENTS

| | | | |
|---|---|---|---|
| 1,149,151 | 8/1915 | Birkenmaier | 197/6 |
| 2,221,424 | 11/1940 | Rexford et al. | 197/6.4 |
| 2,250,567 | 7/1941 | Bates | 197/6.4 |
| 2,980,014 | 4/1961 | Bonsch | 101/91 |
| 3,001,469 | 9/1961 | Davis et al. | 101/93.29 |
| 3,024,723 | 3/1962 | Wasserman | 101/93.29 |
| 3,059,750 | 10/1962 | Schnellman | 197/6.6 |
| 3,138,092 | 6/1964 | Block | 101/91 |
| 3,236,352 | 2/1966 | Schacht | 197/6.6 |
| 3,358,593 | 12/1967 | Ritzerfeld et al. | 101/91 |
| 3,757,684 | 9/1973 | Drillick | 101/18 |

*Primary Examiner*—Edward M. Coven

*Attorney, Agent, or Firm*—Nilsson, Robbins, Dalgarn, Berliner, Carson & Wurst

[57] ABSTRACT

An electronically controlled embossing machine for embossing alpha-numeric characters on flexible sheets such as, for example, plastic or metal credit cards or nameplates. Embossing is accomplished by two constantly rotating embossing wheels which carry radially movable embossing molds about their peripheries. One embossing wheel carries male or projecting embossing molds; the second wheel carries matching female or intaglio embossing molds. Selection of a certain character via a keyboard, or by electrical signals from any data source, causes the appropriate male and female molds to be moved radially outwardly on each wheel by mechanical mold cam levers. A flexible sheet, such as a plastic credit card blank, interposed in the bite of the two embossing wheels, is embossed by the radially extended embossing molds in a rolling-squeezing process. After the embossing of a selected character on the flexible sheet, the previously selected embossing molds are returned inwardly to their original positions and the flexible sheet is indexed to the proper position for embossing of the next character. An electronic system senses the instantaneous position of the embossing wheels and controls the timing of the embossing sequence including actuation of solenoids for the selection and extension of desired embossing molds.

92 Claims, 33 Drawing Figures

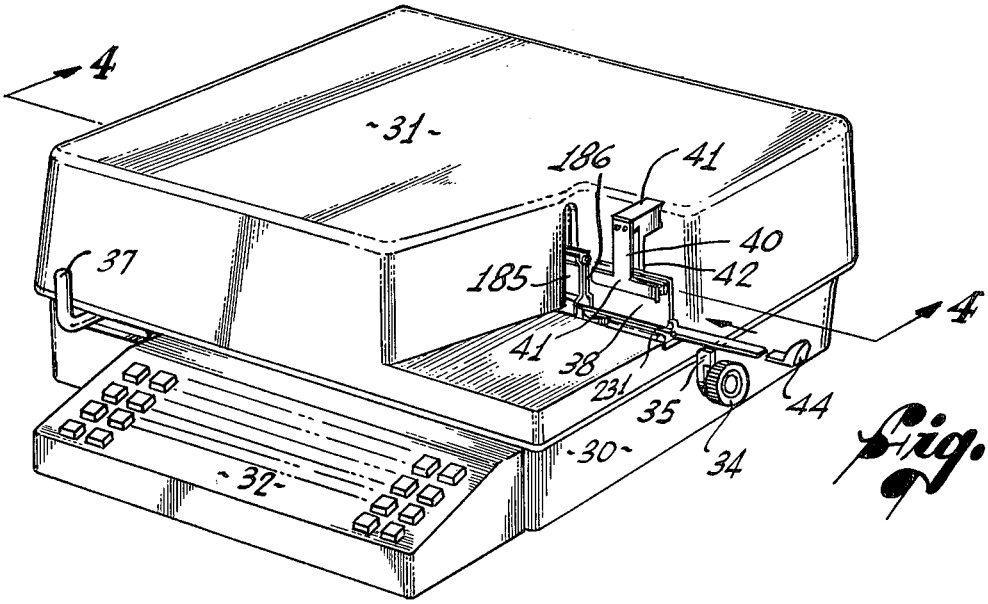
Fig. 1
Fig. 4
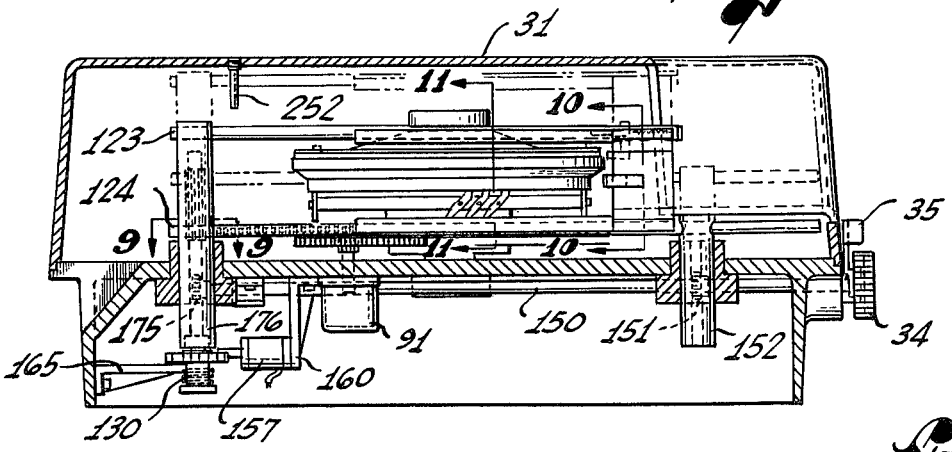
Fig. 11
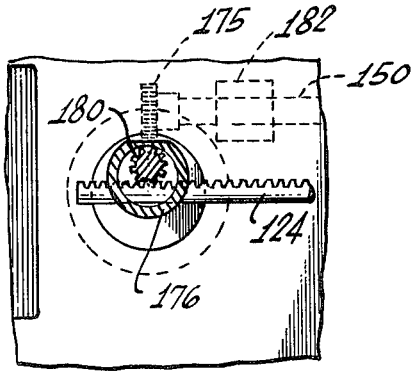
Fig. 9
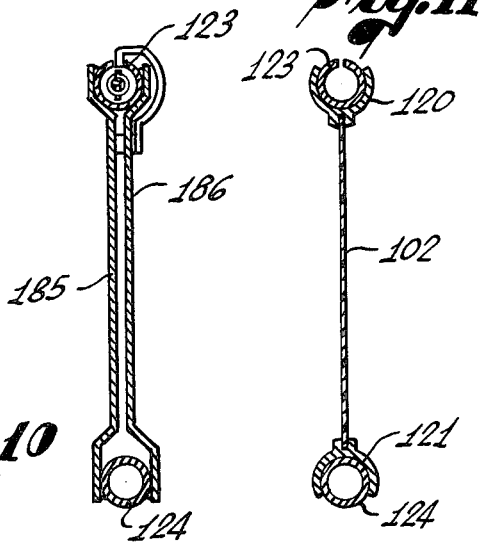
Fig. 10

METHOD AND APPARATUS FOR EMBOSSING CARDS AND SHEETS

This application is a continuation-in-part of application Ser. No. 532,252, filed Dec. 12, 1974, now abandoned.

BACKGROUND OF THE INVENTION

A. Field of the Invention

This invention relates generally to machines or devices for embossing alpha-numeric characters on flexible sheets such as plastic or metal credit cards or nameplates and so forth. More particularly, the invention involves an embossing machine comprising two constantly rotating embossing wheels carrying radially movable embossing molds about their peripheries. One embossing wheel carries male embossing molds in which the alpha-numeric character on each mold projects outwardly. The second embossing wheel carries female or intaglio embossing molds on which the matching alpha-numeric character of each mold projects inwardly. A selected character is embossed in a flexible sheet positioned in the bite of the two embossing wheels by moving the two corresponding molds bearing the male and female representations of the selected character outwardly before they revolve through the bite position. Embossing of the flexible sheet is accomplished by a combination rolling and squeezing motion of the two selected molds.

Provision is made, as a part of the invention, for transporting the flexible sheet to be embossed so as to position it to successively receive the next embossed character. The sheet is moved by the machine of this invention along perpendicular axes for this purpose.

An electronic control system is provided, as part of the invention, for continually sensing the instantaneous position of the rotating embossing wheels. When electronic signals are received, indicating the character to be embossed, the control system determines when the selected character molds pass a reference point about the peripheries of the embossing wheels. At that point, the system actuates mold setting solenoids which cause the selected corresponding embossing molds in each wheel to be cammed outwardly along radii of the wheels.

Also as part of the invention, provision is made for a mechanical camming device for moving selected molds outwardly and locking them in an extended position for embossing the selected character in the interposed flexible sheet. After the embossing of each character, the previously selected molds are unlocked and returned to their original inward position.

In the embodiment shown herein, character selection signals are derived by manual operation of an alphanumeric keyboard in the usual fashion. The invention contemplates, however, that data signals for selection of characters to be embossed may originate from any suitable source, such as magnetic tape, telephone lines, computer memory, video terminals, and so forth.

B. Description of the Prior Art

Many prior art devices have been developed for causing an alpha-numeric character to be embossed on flexible sheets. The art in general is long established, as embossing machines, as will be shown in this section, were designed in large numbers during the prior century.

In the last several years, however, the field has grown tremendously due primarily to the greatly increased use of plastic credit and identification cards. Thousands of companies in the United States and many foreign countries currently issue such cards. Many of the national card companies issue hundreds or even thousands of new or updated cards daily. Obviously, in the face of such increased demand, there is a substantial need for embossing machines capable of producing large numbers of cards accurately, quickly, quietly and cheaply.

It should be understood also that embossing machines, as currently used in many applications, must accept embossing data from sources other than mechanical or electro-mechanical keyboards. As one example, large national companies often initially keypunch card data into standard IBM cards. After verification, the punched data is transferred to magnetic tape for use in card preparation, customer billing, accounting and so forth. The portion of the data to appear in an issued credit card is abstracted and transferred to a further magnetic tape. That tape may then be used to supply embossing data for preparation of the cards.

As a second example, embossed plastic cards are used as part of registration and inquiry systems for conventions attracting large numbers of attendees. In one such system, arriving attendees provide registration information to operators of video terminals. The information is keyed into the terminals by the operators and visually displayed for verification. Following verification, the information is transmitted from the video terminal to a computer for editing and storage. The computer, in turn, in one of its programmed tasks, extracts certain data from the entered information, typically, name, address, and company name, and transmits the extracted data to a card embossing machine. A plastic card is then prepared by the embossing machine for the attendee's use as a name badge and inquiry card to be furnished to exhibitors for recording if the attendee desires to be mailed product information, catalogs and so forth. The entire process of card preparation after the entered date is verified by the video terminal operator requires only a few seconds. Since attendees at large conventions typically arrive at about the same time, the computer controlled embossing machine must produce thousands of embossed cards within a very short period.

Other applications of embossing machines require keyboard input of embossing data and production of relatively fewer cards. For example, many hospitals have adopted a records system in which each entering patient is provided an embossed plastic card bearing, *inter alia,* the patient's name and account number. All charges of that patient for items such as drugs and other supplies are registered using this card. An embossing machine for card preparation in this type of system must be capable of receiving keyboard input, relatively silent operation, must be compact in size and low in cost.

Other types of sheets and cards, of course, are embossed by devices of the prior art and may be embossed by the machine of this invention. For example, metal name and specification plates for attachment to machinery may be embossed in the same fashion as are the plastic credit cards described above.

Most prior art embossing machines for the production of large numbers of embossed cards, as in the national card company example used above, are extremely complex, very large machines costing many tens of thousands of dollars. They generally operate from an array of punches and dies with the actual embossing performed by a selected punch and die struck by hammers or anvils. Generally, the sheet or card to be embossed is moved by transport apparatus along perpendicular axes between the punch and die arrays to receive each successively embossed character. In at least one machine, the entire punch apparatus is moved along perpendicular axes. As a result, such machines are quite noisy. Due to the very great number of operating parts which are struck or impacted by other parts, such machines also experience relatively short component life. An example of such an embossing machine is found in U.S. Pat. No. 3,223,218 to Terzariol.

Traditionally, the smaller embossing machines capable of operating from a keyboard have often employed principles of operation other than that of the Terzariol design. For example, U.S. Pat. No. 3,785,470 to Schacht discloses an embossing machine wherein the embossing characters are arranged around the periphery of a rotating wheel. When an operator depresses a key on the keyboard, a clutch is engaged which stops the character wheel. The sheet or card to be embossed with the selected character is then raised upwardly against the stationary selected character. As the embossed sheet or card is withdrawn, the clutch is disengaged and the character wheel begins to revolve again. Similar embossing machines may be seen in U.S. Pat. No. 520,238 to Libbey, U.S. Pat. No. 2,213,831 to Bates, and British Pat. No. 9,800 to Barker (1894).

Generally, disadvantages are found in machines such as the foregoing in that they may be operated only by a manual keyboard, the start-stop motion of large masses causes vibration and wearing of machine parts, complex clutching mechanisms are required and, because of the inertia of the large moving parts which are clutched, the machines are relatively slow. Further, as a general rule, they are quite noisey, making them inappropriate for many working environments.

A more widely used principle of modern embossing machine operation is disclosed in U.S. Pat. No. 3,763,986 to Deutsch. In the Deutsch design, sets of male and female embossing characters are arranged around the facing inside rims of a pair of embossing wheels rotating on the same axis. Selection of a character by operation of a manual keyboard causes a clutch to stop the rotating embossing wheels. Anvils, or some similar device, impact the selected characters and cause the character to be embossed at the appropriate location in the sheet or card. After the embossing operation, the clutch is disengaged allowing the wheels to rotate until the next character is selected.

A similar design is shown in U.S. Pat. No. 3,029,920 to Seifried. The Seifried embossing machine includes movable character punches and dies which are driven parallel to the axis of rotation of the embossing wheel when struck by anvils. Like the Deutsch design, the Seifried embossing machine is clutched when a character is embossed.

As previously stated, the start-stop operation of the embossing wheels is noisy, requires complex mechanical clutching and results in wear of components. Further, also as previously stated, the inertia of the clutched embossing wheels restricts the speed of the machine.

Other types of embossing machines have been designed in which male embossing characters are arranged around the periphery of a first embossing wheel and female characters around a second wheel. Typical of devices of this type is the embossing machine described in U.S. Pat. No. 2,250,567 to Bates. The Bates machine is used for embossing small metal bands such as are used for marking legs of poultry. The embossing wheels are geared to rotate together and are positioned manually by the operator to select a character for embossing. When the wheels are in the proper position to emboss the desired character, a foot petal is depressed by the operator, causing the wheels to move together radially. Similar embossing machines may be found disclosed in U.S. Pat. No. 2,221,424 to Rexford, et al., and German Pat. No. 6,677 (1878).

Such devices of the prior art, however, are unacceptable for high-volume production of embossed cards or sheets. First, selection of desired embossing characters is accomplished manually and, therefore, machine operation is quite slow. Secondly, the requirement of radial travel of a relatively large mass of one of the embossing wheels also insures low speed and vibration. Finally, component wear is caused by the change of movement direction of large masses and the necessary absorbtion of energy.

Finally, the male-female character approach has been incorporated in embossing machines wherein the characters are carried by flexible bands. For example, U.S. Pat. No. 3,010,387 to Deutsch discloses such a design in which the characters and the bands are integrally molded from nylon. After the band is positioned above and below the proper location of the plastic card, anvils strike the two bands, forming an embossed character. A somewhat similar design for embossing a plurality of characters simultaneously is disclosed in U.S. Pat. No. 3,666,072 to Austin.

Such devices, while acceptable for use in production of low numbers of embossed sheets or cards, are unsatisfactory for embossing high numbers of cards or embossing metal plates. Also, as with any flexible band repeatedly impacted with a metal anvil or hammer, substantial wear of the band and characters is encountered.

SUMMARY OF THE INVENTION

In accordance with this invention, provision is made for the embossing of flexible sheets of plastic or metal cards at high rates by a machine which may be produced for relatively low cost, operated with relatively high component reliability, operated in relative silence, and which can accept embossing data from virtually any type of source.

Embossing is accomplished by a pair of continuously rotating embossing wheels which carry, about their peripheries, corresponding sets of male and female embossing molds. Each embossing mold is so mounted in its embossing wheel that it may move radially for a short distance. In the nonselected position, the outer faces of the embossing molds are approximately even with the edges of the rotating embossing wheels. When selected, the corresponding male and female embossing molds are cammed outwardly a short distance.

The rotating embossing wheels are so spaced that a flexible sheet or card may be placed between them untouched so long as no characters are selected for embossing. When a character is selected and the corresponding male and female embossing molds are cammed outwardly, however, the selected character is embossed in the sheet or card.

Nearly all of the prior art devices emboss via a punch or punch-die combination which is struck by an anvil or hammer. In accordance with this invention, embossing is accomplished by a rolling-squeezing motion, obviating mechanical impact, substantial vibration, change of movement direction of large masses, and so forth. The result is a smoothly operating, relatively silent and dependable embossing machine. Further, due to the flywheel effect of the continuously rotating embossing wheels, less energy is required for embossing than in prior art devices.

Following selection of a character for embossing by a keyboard entry or receipt of a character code from any source, two mold setting solenoids located at a fixed angular position on each embossing wheel are energized by an electrical control circuit as the selected embossing molds pass the solenoids. Each solenoid is caused to rotate a mold cam lever behind the selected embossing mold, forcing the mold radially outwardly to an extended position. The embossing molds are locked in this extended position by the mold cam levers as they are passed through the bite of the two embossing wheels, causing the selected character to be embossed in the flexible sheet or card. As the selected embossing molds rotate away from the bite of the wheels following embossing, the mold cam levers are rotated back to their original positions, allowing the previously selected embossing molds to move inwardly.

Provision is also made in accordance with this invention to transport the flexible sheet or card along perpendicular axes in the embossing machine and, finally, to eject a completely embossed card.

An electronic control system operates the embossing machine of this invention from any properly formatted data source, including manual keyboard, telephone lines, magnetic tape, computer memory, or any similar electronic input. The ability of the embossing machine of this invention to interface with virtually any type of input is a substantial advantage over prior art designs.

Many other advantages are found in the design of the invention over the prior art machines. Compared to prior art machines having approximately the same card production rate, the embossing machine of this invention is substantially cheaper. Primarily, this is due to the relatively simple embossing principle employed which does not utilize hundreds or thousands of moving parts as do the prior art machines having the same approximate speed. Further, also compared to such machines, the embossing machine of this invention is much smaller, quieter, and far more reliable in terms of component wear.

Compared to embossing machines in the prior art which sell for about the same price, the embossing machine of this invention is far faster and, unlike the prior art machines, can interface with any properly formatted source of embossing data.

As may be readily appreciated, the above described advantages of the embossing machine of this invention are very substantial.

BRIEF DESCRIPTION OF THE DRAWINGS

FIG. 1 illustrates the exterior design of the embossing machine of this invention of the embodiment which accepts embossing data from a manual keyboard.

FIG. 4 is a section view taken along the lines 4—4 of FIG. 1, showing one embossing wheel, the motor for driving the embossing wheels and parts of the card transport mechanism.

FIG. 9 is a section view taken along the lines 9—9 of FIG. 4, showing part of the card transport mechanism.

FIG. 10 is a section view taken along the lines 10—10 of FIG. 4 showing a cross-section of the card entry guide and an end view of the card registration link.

FIG. 11 is a view taken along the lines 11—11 of FIG. 4, showing a section view of the horizontal card guides for allowing the sheet or card to travel in the horizontal direction in the embossing machine of this invention.

DESCRIPTION OF THE PREFERRED EMBODIMENT

This invention concerns a machine for embossing alpha-numeric characters in flexible sheets of metal, plastic or other similar material. In the following detailed descriptions, for ease of reference, the media embossed will be referred to as a "card." This is not, of course, intended to be limiting in any way as the embossing machine of this invention may be used to emboss flexible sheets of all commonly used sizes, thicknesses and materials.

Figures 3, 3A:
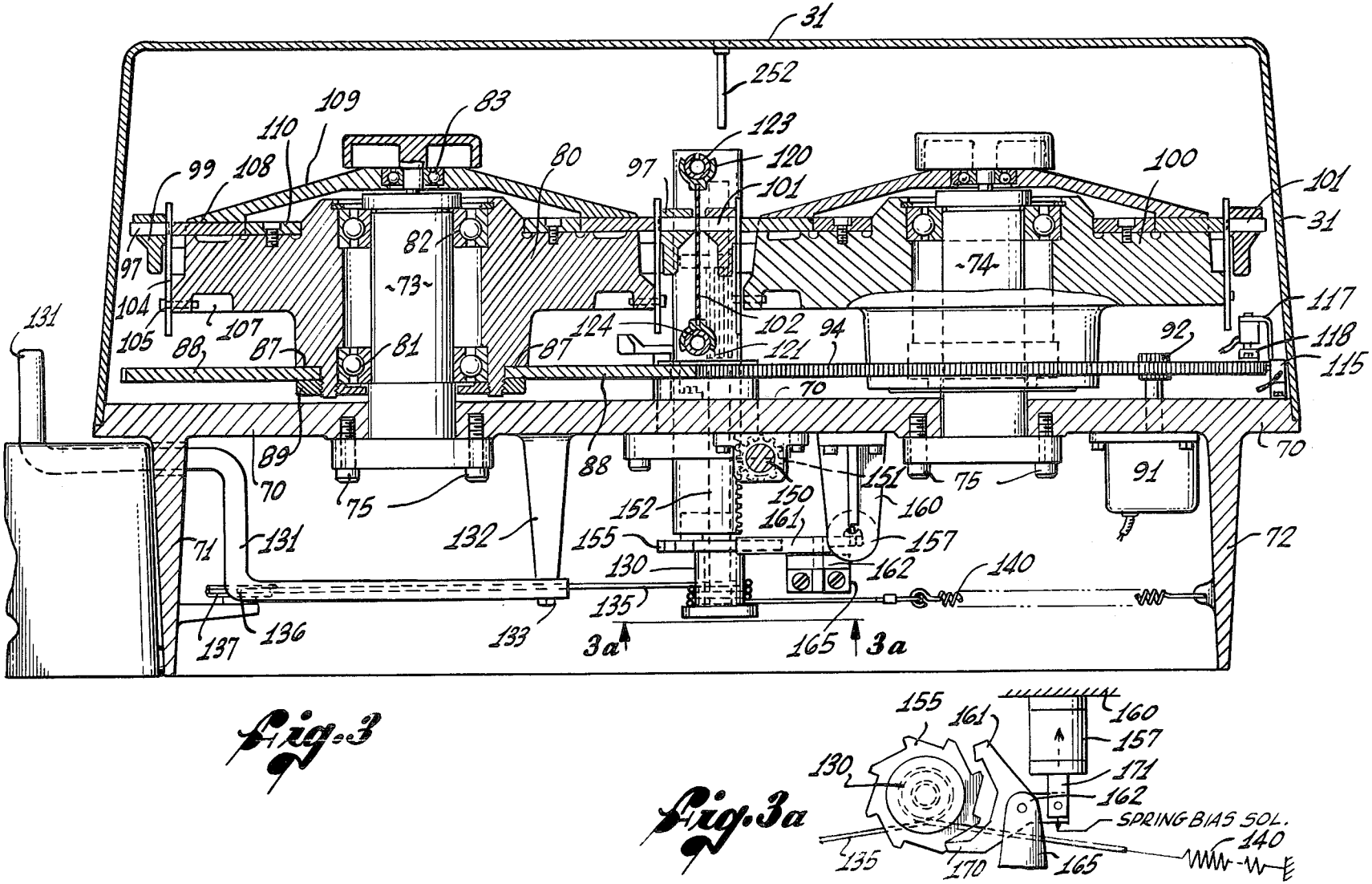
FIG. 3 is a section view taken through the axes of the two embossing wheels showing the details of the wheel design and the mechanism for indexing the flexible sheet or card in the vertical direction.
FIG. 3*a* is an end view taken along the line 3*a*—3*a* of FIG. 3 of the pinion shaft and cable spool mechanism.

A major application of this invention is the embossing of plastic or metal credit cards. The American National Standard size for such cards is 3.375 inches in length, 2.125 inches in height, and 0.030 inches in thickness. The drawings herein illustrate the invention embossing such a credit card. As is readily apparent, however, a change in size of the media to be embossed would simply require a change in dimensions in either the card transport mechanism, the space between the embossing wheels or some other appropriate dimensional change. For example, if a thicker sheet is to be embossed, the space between the embossing wheels (as shown in FIG. 3) may be increased. Alternatively, the dimensions of the embossing molds, and the mold cam levers and the width of the backup ring may be appropriately changed. All such changes in dimension may readily be made without departing from the scope of this invention.

Referring to FIG. 1, the exterior design of the embossing machine of this invention is shown in the embodiment of the invention in which embossing data is supplied via manual entry on a keyboard. The embossing machine is mounted on a base 30 to which is attached a machine cover 31. The machine cover 31, in the preferred embodiment, is coated on its interior surface to reduce sound caused by operation of the embossing mechanism.

A manual keyboard 32 is attached to the embossing machine base. It is provided with the usual alphanumeric keys, that is, there is one key provided for each character which may be embossed.

A line advance knob 34 is located on the right hand side of the embossing machine base. As in a typewriter, rotation of the line advance knob in a clockwise direction causes the card transport mechanism to raise the card for embossing on successive lines. The line advance knob is provided with detents as in the usual case so that a card may be raised or lowered exactly one character-line. In the event the operator wishes to raise or lower a card by an amount other than integral numbers of character lines, a lever 35 is provided which renders the detent mechanism inoperative.

In order to return the card transport mechanism and the card to their original horizontal positions to begin embossing on successive lines, a line return lever 37 is provided on the left side of the embossing machine base. After each line is embossed, the embossing machine operator moves the line return lever from the position shown in FIG. 1 to the operator's right. The card transport mechanism is then caused to move the partially embossed card to the right to its original horizontal position. The operator then rotates the line advance knob 34 one space and the card is in a proper position for beginning the next line of embossing.

In the embodiment illustrated, a blank card 38 is inserted manually by the operator in upper and lower card emplacement guides 40, 231. The upper card emplacement guide 40 is rigidly attached to the embossing machine cover 31 via a top piece 41. The upper card emplacement guide consisting of two inverted T's 41, 42 is attached to the cover by the top piece. The purpose of the inverted T's 41, 42 is to position the upper part of an inserted card 38 in a front to back direction. The lower edge of the card is positioned in a slot in the lower card emplacement guide 231 (shown in FIGS. 13 and 14). After the card is properly positioned in the card emplacement guides by the operator, a card insertion ram 44 is manually moved to the operator's left. This moves the card 38 to the left in the upper and lower card emplacement guides 40, 231. As will be subsequently explained in detail, the card insertion ram moves the card to the left until the card comes to rest within the card transport mechanism. At that time, the card is properly positioned to be embossed by the first selected character.

Figure 2:
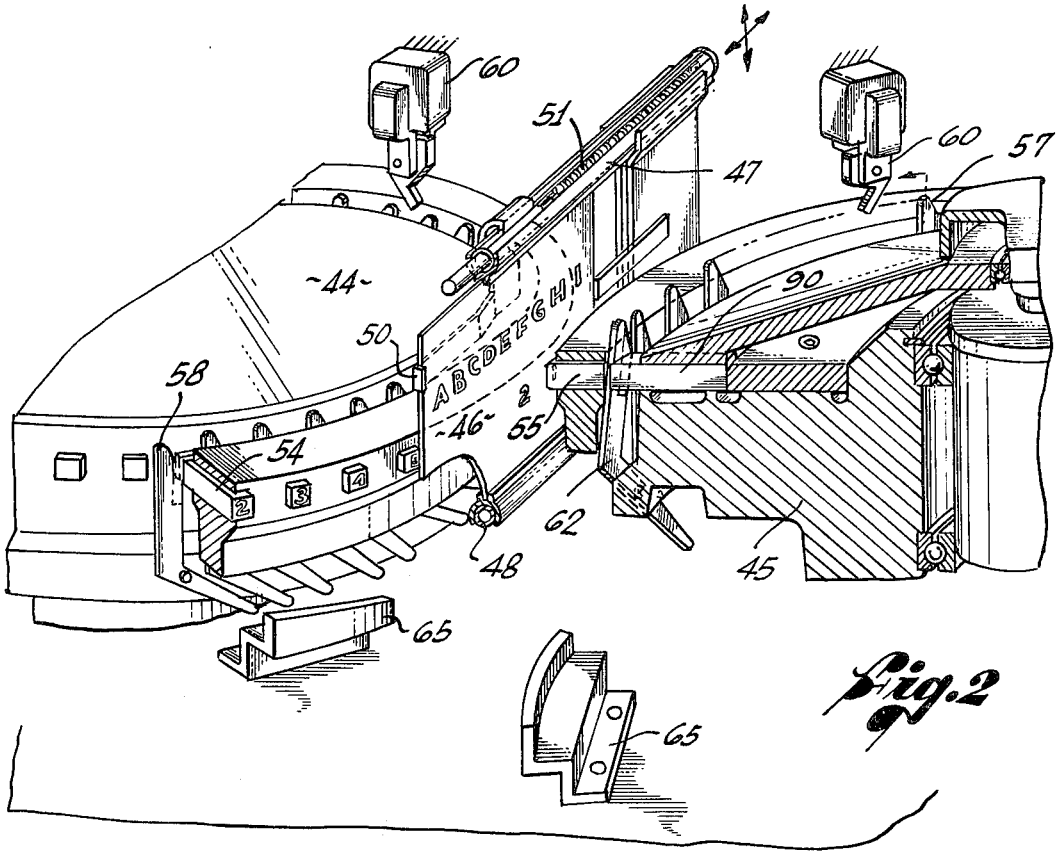
FIG. 2 illustrates the embossing principle utilized by this invention, including the constantly rotating embossing wheels bearing the male and female embossing molds and the mold cam levers for projecting the selected embossing molds.

The principle of operation of the embossing machine of this invention may be seen by reference to FIG. 2, in which the principal components are shown diagrammatically. The invention comprises two constantly rotating embossing wheels 44, 45. The wheels are interlocked via ring gears (not shown) located around the periphery of each and are driven by a single motor. Accordingly, the relative angular positions of the rotating embossing wheels remain constant. A partially embossed card 46 is shown positioned for embossing by upper and lower horizontal card guides 47, 48. As will be explained in detail below, card guides 47, 48 are part of the card transport mechanism. The credit card 46 is urged to the right in FIG. 2 by a card registration link 50 resiliently attached to part of the embossing machine frame (not shown) via registration link spring 51.

A plurality of embossing molds, such as 54, 55, are mounted for radial movement around the peripheries of the two embossing wheels 44, 45. Each of the embossing molds mounted in embossing wheel 44 carries a male (i.e., projecting) embossing character. Located at corresponding positions in embossing wheel 45 are embossing molds bearing female characters, also mounted for radial movement. The character embossed in card 46 by the described embossing molds will appear in relief on the side of the card shown in FIG. 2. This is the most common manner of embossing as the relief characters may then be tipped by inking devices for easy sight recognition. In those cases, however, in which reverse embossing is to take place, it is only necessary to reverse the male and female embossing molds between the two embossing wheels.

In the preferred embodiment of this invention, the embossing wheels rotate at approximately 120 revolutions per minute. The time required to emboss a character after entry of a character selection code is primarily dependent upon the speed of the embossing wheels and the position of the selected embossing mold at the time of data entry. The worst possible case, of course, is when the two selected embossing molds have just passed the mold setting solenoids at the time of entry. In such a case, the selected embossing molds must make one complete revolution to the mold setting solenoids and then must revolve from the solenoids to the bite of the embossing wheels.

Conversely, the best case is when data entry occurs just before the selected embossing molds reach the mold setting solenoids. In this case, the selected embossing molds need only to revole from the mold setting to the bite of the embossing wheels.

The average, of course, for randomly entered data falls between the two cases cited above. It has been found that the embossing machine of this invention is capable of producing 200 to 300 embossed cards per hour, assuming a typical number of characters embossed per card.

It is believed that even higher rates of embossed card production could be obtained by increasing the rotating speed of the embossing wheels to as much as 200 revolutions per minute. There is, it is believed, a maximum speed, probably established by the minimum times required for the various components and the card to come to rest after a character is embossed. The maximum speed has not, however, been established.

Further, in the preferred embodiment, a single set of alpha-numeric characters has been located around the periphery of each embossing wheel. That is, one complete revolution of the wheels is necessary for each embossing character to have passed a given point. It is contemplated, however, that increased speed may be obtained by placing multiple sets of embossing molds in each wheel. In that way, each of the available characters would pass a given point following only a partial revolution of the embossing wheels.

The normal and non-actuated position for the mold cam levers is that shown in FIG. 2 by levers 57, 58. That is, the levers are rotated so as to not be in contact with the back surface of the embossing molds. As long as no character has been selected for embossing, the card 46 remains untouched as all mold cam levers are in the position shown by levers 57, 58 and all embossing molds are in a retracted position.

When a character is selected for embossing, electronic control circuitry, to be explained in detail below, causes mold setting solenoids 60 to extend their armatures at the moment the two corresponding selected embossing molds pass beneath. As a result, the mold cam levers are rotated to the position shown by mold cam lever 62 in FIG. 2. A cammed surface on the mold cam lever causes the adjacently mounted embossing mold to be forced outwardly and locked in the position shown in FIG. 2 by embossing mold 55.

The dimensions of the various components are such that the projected embossing molds cause the selected character to be embossed in card 46. In FIG. 2 this is represented by the numeral 1.

It should be noted that mold cam lever 62 is positioned in FIG. 2 between the rear face of the embossing mold 55 and a backup ring 90 of the embossing wheel. Accordingly, no moment forces on the cam lever about its lower parts produce movement. All radial forces created by resistance of the card to embossing are absorbed by the main body of the embossing wheel via backup ring 90.

Finally, it should also be noted again that there is mounted, on embossing wheel 44, an embossing mold and mold cam lever corresponding to embossing mold 55 and mold cam lever 62. The corresponding embossing mold and mold cam lever have been omitted for clarity of illustration only.

It is an important feature of this invention that embossing is accomplished by the extended embossing molds in a combination rolling-squeezing process. That is, embossing begins slightly to the back of the bite position of the card shown in FIG. 2. As the embossing molds revolve toward the common axis of the two embossing wheels, embossing begins and the card 46 is carried with them. In this way, the character is embossed into the card 46 by the rolling-squeezing motion of the embossing molds.

Following the embossing of a character, velocity is imparted to the card 46 equal to the tangential velocity of the embossing molds. The card is allowed to travel in the direction of the velocity within the horizontal card guides against the action of registration link spring 51. After the extended embossing molds have rotated away from the card 46 and have passed, link spring 51 returns the card to its original position. At the same time, as will be explained below, the electronic control circuitry causes the card to be indexed one character position so as to be in position to receive the following selected character.

Following embossing of a selected character, as illustrated by the number 2 in FIG. 2, the extended embossing molds, such as embossing mold 54, rotate away from the card 46. They remain locked into their extended positions until the depending portions of their mold cam levers strike the return cams 65. As shown, the return cams cause the mold cam levers to rotate to their original positions from behind the associated embossing molds. There are, of course, two return cams, one for each embossing wheel.

The detail of the embossing machine of this invention will be described below. However, it is thought that the basic principle of operation of the embossing machine of this invention can be understood by reference to FIG. 2. It should be noted that the only embossing components which are required to change directions of movement during an embossing cycle are the embossing molds and the mold cam levers. These components are, of course, of relatively low mass and the speed of their movement is not high. Consequently, the embossing action of this invention is relatively silent and causes virtually no vibration.

FIG. 3 is a section view of the embossing machine of this invention taken through the common axis of the two embossing wheels. The frame of the embossing machine comprises a bottom plate 70 and two rectangular legs 71, 72. Two embossing wheel axles 73, 74 are attached to the bottom plate 70 of the embossing machine frame by standard machine bolts 75.

The embossing wheels are identical except that one carries male embossing molds and the other carries female molds. Accordingly, only one of the embossing wheels will be described in detail. The embossing wheel 80 is rotatably mounted on wheel axle 73 by two roller bearings 81, 82.

As previously described in connection with the description of FIG. 2, all of the embossing force is absorbed by the main body of the embossing wheels. It is absolutely essential that the embossing force not cause the axes of rotation of the embossing wheels to move apart significantly. Accordingly, it is important that the embossing wheel axle 73 be firmly and rigidly mounted to the bottom plate 70 of the embossing machine frame.

Mounted against a shoulder 87 of the lower portion of the embossing wheel body 80 is a ring gear 88. The ring gear is held against shoulder 87 by a large threaded ring 89. It is essential that the ring gear 88 not rotate with respect to the embossing wheel 80. Accordingly, the ring gear may be mounted on the main body 80 of the embossing wheel by splines or held in place, as in the preferred embodiment, by a key.

As is readily apparent from FIG. 3, the ring gears of the two embossing wheels tightly mesh. Accordingly, the wheels rotate in opposite direction at the same speed and maintain a constant angular relationship with respect to each other.

The embossing wheels are driven by an electric motor 91 which is bolted to the underneath side of the bottom plate 70 of the embossing machine frame. The motor 91 drives a small spur gear 92 which is so positioned as to mesh with ring gear 94 of the right-hand embossing wheel (as viewed in FIG. 3).

A set of embossing molds 97 are mounted in appropriately sized apertures around the periphery of the embossing wheel 80. The embossing molds are so mounted that they may move radially for short distances. They are, of course, suitably restrained so that they may not be projected out of their apertures by centrifugal forces caused by the rotating embossing wheels. In the preferred embodiment, there is a complete set of alphanumeric characters equally spaced around the periphery of the embossing wheel 80. The set includes upper and lower case alphabetic characters and small and large numeric characters. In addition, of course, punctuation and special characters, such as an ampersand, may also be included.

The embossing molds 97, in the preferred embodiment, bear on their outward faces female impressions of the character set, with one character appearing on each embossing mold. A similar corresponding set of embossing molds 101 mounted about the periphery of embossing wheel 100 bear male representations of the character set. Again, one character appears on the outer face of each embossing mold. For example, to emboss a numeral 2 in a card 102, embossing mold 97 (adjacent to the card) would bear a female representation of the numeral 2. Embossing mold 101 (adjacent to the card) would bear a male representation of numeral 2. The two embossing molds would coact to produce an embossed numeral 2 in the card 102. The embossed numeral would be convex on the left side of the card as it is viewed in FIG. 3. In many applications, a tipping mechanism (not shown) would later ink the convex side of the embossed characters in the card 102 for aiding sight recognition of the embossed characters.

Mold cam levers 104 are rotatably mounted on the embossing wheel body 80 by the pins 105. A cavity 107 is provided inwardly of each mold cam lever so that the pins 105, which are press fitted, may be easily removed by punching them into the cavity 107. The mold cam lever 104 projects upwardly from the pin 105 into a space provided behind the embossing mold 97. The various parts are so dimensioned that the mold cam lever can rotate about its pin 105 from the first position completely clear of the rear face of the embossing mold to a second position in which it is interposed between the rear face of the embossing mold 97 and the outer edge of the backup ring 108.

The backup ring 108 is positioned and held in place in the radial or horizontal direction by the lock ring 110 fixedly attached to the main embossing wheel 80 by machine bolts 112. The backup ring 108 is held in place vertically by wheel cap 109. The backup ring is designed to be removable so that it may be changed to a similar part of different dimension in the event the travel of the embossing molds must be changed. As was described above, media of different thicknesses may be embossed by this invention by varying the distance the embossing molds project upon selection or the maximum inward distance they are allowed to travel when not selected. These dimensions, of course, may be most easily varied by changing the dimensions of backup ring 108.

As will be described later in connection with the electronic control system of this invention, the system maintains an instantaneous count of the position of each of the embossing wheels by counting the teeth of the ring gear 94. A magnetic sensor 115 is mounted to the upper face of the machine bottom plate 70 for this purpose. As will be described later, magnetic sensor 115 detects the passage of each tooth of ring gear 94 by detecting the difference in its surrounding magnetic field caused by the passage of a tooth as compared to the passage of gaps between teeth. The electronic circuitry resets once every revolution under the control of magnetic sensor 117 which detects passage of a magnetic block 118 fixedly attached to the upper face of ring gear 94. The magnetic block 218 passes beneath magnetic sensor 117 once for each revolution of the embossing wheels. Accordingly, the output pulses of sensor 117 may be counted as an indication of revolutions of the embossing wheels and the output pulses of magnetic sensor 115 may be counted as the passage of each gear tooth within each single revolution. In this way, the electronic control circuit is provided with a constantly changing indication of the exact position of the embossing wheels as they rotate.

The structure of the card transport mechanism utilized in the embossing machine of this invention to position a card to be embossed with a selected character will be discussed in connection with the various figures herein. The card 102 is loosely held within an upper horizontal card guide 120 and a lower horizontal card guide 121. Both of the card guides are longitudinal clips fixedly attached to horizontal transport tubes 123, 124. As will be explained in connection with a further figure, the transport mechanism moves the horizontal transport tube horizontally in relation to the embossing wheels as successive characters are embossed in the card. The lower horizontal transport tube 121 is provided with gear teeth forming a rack. Meshed with the rack is a small pinion which rotates about a vertical axis (shown in detail in FIG. 9). The pinion shaft is fixedly attached at its lower end to a cable spool 130. The purpose of the cable spool is to provide the torque which allows the embossed card to be stepped successively to the operator's left as characters are embossed.

The line return lever 131 is pivotally mounted on pin 133 in a stub 132 which depends from the underside of the bottom plate 70. A flexible cable 135 is attached to the line return lever at aperture 135, passed around a wheel 137, wrapped around a cable spool 130 and attached to a tension spring 140. At about its midpoint of the portion of the cable 135 wrapped about a cable spool 130, it is fixedly attached to the spool by the pin or clamp. The tension spring, in turn, is fixedly attached at its opposite end to an aperture in a boss of the leg 72 of the embossing machine frame.

As the operator moves the line return lever to its right (out of the drawing of FIG. 3), spring 140 is caused to be stretched as the line return lever draws the cable 135 around the spool 130. This causes the pinion and rack combination to move the card 102 to the operator's right or out of the drawing of FIG. 3 of a position located to receive the first embossed character of the next successive line. As successive characters are embossed, the spool is allowed to rotate as urged by spring 140 in one character-space increments. The escapement mechanism for providing the one character-space rotation is shown in FIG. 3(*a*).

In addition to horizontal spacing, it is also necessary to move the card in a vertical direction in order to emboss the multiple lines of characters. It will be recalled in connection with the discussions of FIG. 1 that the operator may raise or lower the card transport mechanism, and thereby the card, by rotation of a line advance knob. Referring to FIG. 3, rotation of the line advance knob causes shaft 150 to rotate. Near the ends of shaft 150 are mounted small pinions 151 which mesh with racks located on a vertical transport tube 152. The horizontal transport tubes 123, 124 are mounted for horizontal motion within the vertical transport tube 152.

In order to provide stepping of the embossed card from the operator's right to left for the proper spacing of successively embossed characters, an escapement mechanism is provided on the lower end of the vertical transport tube 152. The escapement wheel 155 is rigidly attached to the vertical transport tube at the upper end of the cable spool 130. An escapement solenoid 157 is attached to a bracket 160 depending from the underside of bottom plate 70 of the embossing machine frame. An escapement lever 161 is rotatively mounted on pin 162 attached in turn to the frame of the embossing machine by brackets 165. The escapement mechanism may be better seen by reference to FIG. 3(*a*).

Referring to FIG. 3(*a*), a view of the escapement mechanism as taken along the lines 3*a*–3*a* of FIG. 3 is shown. Cable 135 is wrapped as shown about cable spool 130 and urged to the right in the drawing by spring 140. Accordingly, the cable causes the escapement gear 155 to be urged in a counterclockwise direction as seen in the drawing. When the escapement lever 161 is in the position shown in the drawing, rotation is stopped in the usual manner of an escapement mechanism by lower finger 170. However, when escapement solenoid 157 is energized, its armature 171 is drawn upwardly, causing the escapement lever to pivot in a counter-clockwise direction. As a result, lower finger 170 drops below contact with escapement gear 155 and the gear is allowed to rotate under the pull of spring 140 until stopped by the upper finger of the escapement lever. When the escapement solenoid 157 is deenergized, the escapement lever revolves back to the position shown in FIG. 3(*a*) which again releases the escapement gear for a partial revolution. The revolution continues until lower finger 170 contacts the next successive tooth in the escapement sprocket. Accordingly, for each energization of the escapement solenoid, the escapement sprocket rotates one tooth. The amount of the rotation and, therefore, the distance the card is moved forward, is determined by the spacing of teeth in the sprocket. In the preferred embodiment, the escapement mechanism components are sized so as to allow sufficient rotation of the cable spool to produce horizontal movement of the card 0.143 inches. This provides the proper character spacing for standard cards and character sizes currently in use. Obviously, if different character spacing were desired, it would only be necessary to vary the dimensions of the escapement mechanism shown in FIG. 3(*a*). Such changes could be made, of course, without departing from the scope of the invention disclosed herein.

Details of the card transport mechanism may be seen from reference to FIG. 4, wherein upper and lower horizontal transport tubes 123, 124 may be seen. The horizontal transport tubes are supported within vertical transport lines 152, 176. As previously described, rotation of shaft 150 rotates pinions 151, 175 and causes a vertical movement of the vertical transport tubes, moving the card in a vertical direction.

Figure 5:
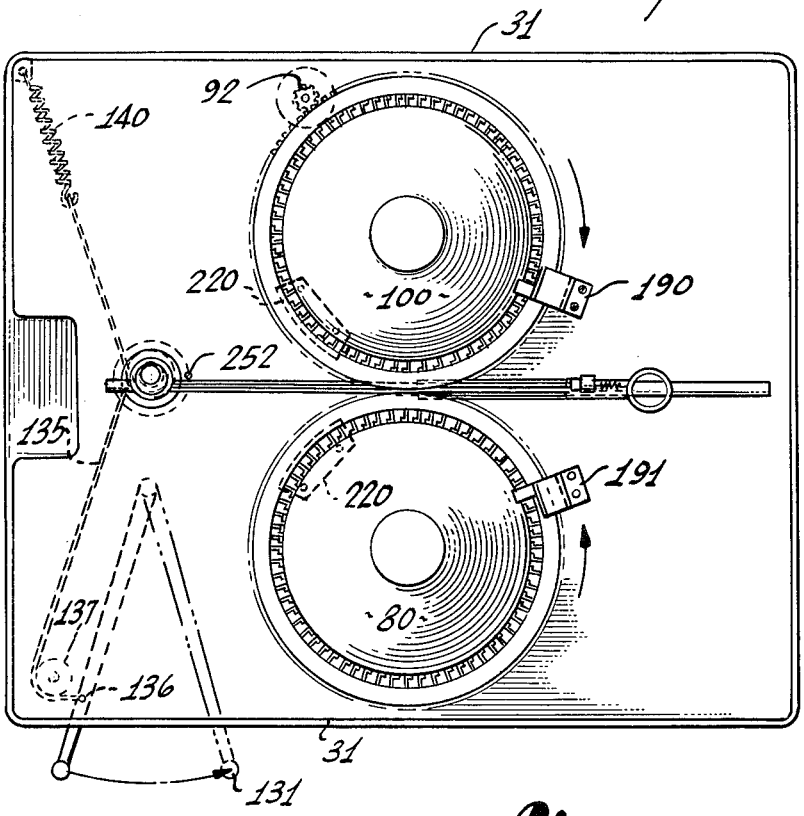
FIG. 5 is a plan view from above the two embossing wheels, showing the operation of the line return lever and the angular position of the mold cam lever actuating solenoids.

Referring to FIG. 5, the embossing wheels, 80, 100 are shown from above. As has been previously explained, the card is held in a card transport mechanism, including upper horizontal transport tube 123. As successive characters are embossed, the card is urged to the left in FIG. 5.

After a line is completely embossed in the card, the operator moves the line return lever 131 to the right as shown in the drawing. The cable 135, passed around wheel 137, caused the cable spool and the associated vertical transport tube to revolve in a counter-clockwise direction while stretching spring 140. The pinion attached to the vertical transport tube also rotates in a counter-clockwise direction and causes the transport mechanism to move to the right in FIG. 5, thereby horizontally positioning the card for the next line of embossing.

As has been previously described, entry of a character selection code causes one cam return lever on each embossing wheel to be rotated behind its associated embossing mold. A pair of mold setting solenoids 190, 191 are provided for this purpose. It is, of course, essential that the two actuating solenoids be located at the same angle from the vertical on each of the two embossing wheels so that corresponding embossing molds will be selected.

Figure 6:
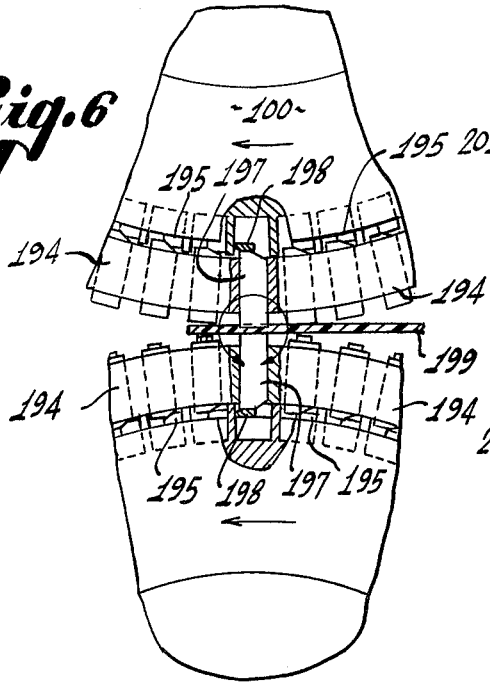
FIG. 6 illustrates a portion of the two embossing wheels as selected embossing molds pass through the bite of the wheels.
Figure 7:
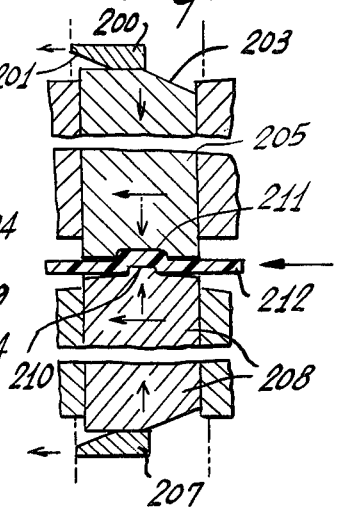
FIG. 7 is an enlarged view of the selected embossing molds of FIG. 6 as a character is embossed in an interposed sheet or card and shows a cross-section of the mold cam levers.

FIGS. 6 and 7 illustrate the action of selected embossing molds. Referring to FIG. 6, the two embossing wheels 80, 100 are shown with a plurality of embossing molds 194, each associated with a mold cam lever 195. The two embossing molds 197 located along the common axis of the two embossing wheels have been previously selected by rotation of their associated mold cam levers 198 so as to project the embossing molds outwardly in a radial direction. As a result, the character carried by the two embossing molds is embossed in card 199.

FIG. 7 is an enlarged view of the action of selected embossing molds of FIG. 6. Mold cam lever 200 may be seen to have a ramp portion 201 which forms the cam surface. Prior to entry of the selection code of the selected character, mold cam lever 200 is in a position to the right of that shown in FIG. 7. On entry of the code, the mold cam lever 200 is moved to the left to the position shown in FIG. 7. As ramp 201 bears against embossing mold ramp 203, the embossing mold 205 is urged outwardly. Since the mold cam lever 200 is rotated by the mold setting solenoids past the ramps 201, 203, the embossing mold is locked in its projected position shown in FIG. 7.

A similar mold cam lever 207 has caused embossing mold 208 to also be projected outwardly. Embossing mold 209 is provided with a projecting character 210. A female representation 211 of the same character found in embossing mold 205 is carried by the embossing mold 208. By the previously described rolling-squeezing process, the character is embossed in card 212.

As may be appreciated, the spacing between the embossing wheels and the dimensions of the embossing molds are such that the embossing molds not selected are free to rotate past the two faces of card 212. It is only when two corresponding embossing molds have been cammed outwardly and locked in the outward position as shown in FIG. 7 that the character carried by the two molds is embossed in the card.

Figure 8:
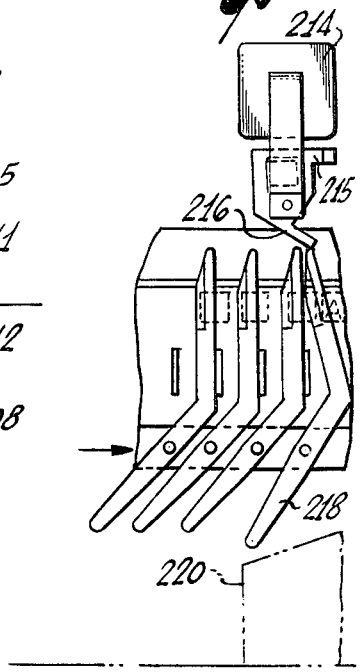
FIG. 8 illustrates one of the mold setting solenoids as it rotates a mold cam lever behind a selected embossing mold.

Operation of a mold setting solenoid may be seen by reference to FIG. 8. The actuating solenoid 214 is of typical construction and has an armature 215 made for partial rotatable motion at its lower extremity. The armature 215 is provided with a downwardly projecting finger 126. Ordinarily, when the armature is not energized, armature 215 is in its counter-clockwise position and finger 216 is lifted above the height of the mold cam levers passing beneath as the embossing wheels rotate. When the control circuitry energized the solenoid 214, the armature 215 is caused to rotate in a clockwise direction, dropping the finger 216 to impact against the upper end of the selected mold cam lever 128. As a result, the selected mold cam lever rotates counter-clockwise to the position shown in FIG. 8 and causes its associated embossing mold to be projected outwardly.

As illustrated in FIG. 8, a return cam 220 provides a ramp surface which causes the previously selected mold cam lever to be rotated clockwise to its original position. This allows the projecting embossing mold to be returned inwardly. The return cam 220 is shown diagrammatically in FIG. 8 as it is located beyond the bite of the embossing wheels (FIG. 5).

Operation of the rack and pinion arrangements for vertical and horizontal movement of the card transport mechanism may be seen by reference to FIG. 9. The lower horizontal transport tube rack 124 is shown meshed with pinion 180. As pinion 180 is revolved by the escapement mechanism, or by the line return lever, rack 124 moves in a horizontal direction, thereby positioning the card for embossing by the next selected character. Similarly, vertical transport tube 176 is moved in a vertical direction by pinion 175 as the line advance knob 34 rotates shaft 150. Shaft 150 is rotatably connected to the machine frame by appropriate journals 182 located adjacent to each end of the shaft.

FIG. 10 is a section of a portion of a card entry guide taken along the lines 10—10 of FIG. 4. As will be explained in connection with the description of FIG. 12, after a card is manually positioned at the entry by the operator, actuation of the card insertion ram (44, FIG. 1) causes the card to be moved into the machine. In order to align the card in a front to back direction for the horizontal card guides, plates 185, 186 which constitute the card entry guide are fixedly attached to the horizontal transport tubes. When the tubes are in their far right position and, therefore, ready for insertion of a card, entry plates 185, 186 are adjacent to the card input station (shown in FIG. 1).

Referring to FIG. 11, card 102 is shown positioned within the slots of horizontal card guides 120, 121. As previously described, the card guides 120, 121 are rigidly attached to the horizontal transport tubes 123, 124. Slots are provided in the card guides of a sufficient size to loosely guide the upper and lower edges of card 102. As may be readily appreciated, the width of the slots in the card holders 120, 121 must be slightly larger than the width of the media being embossed. The width dimension of the slots may be easily changed without departing from the spirit of this invention to provide for medias of differing thicknesses.

Figure 12:
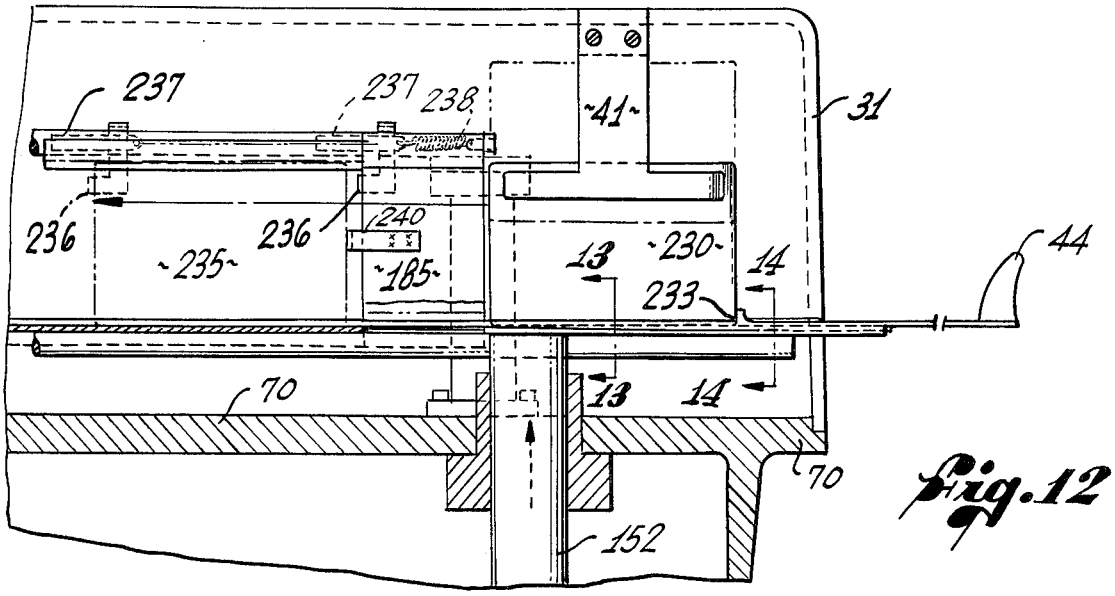
FIG. 12 is a section view of the card input portion of the embossing machine of this invention.

Referring to FIG. 12, the card input station is shown in detail. As previously described, to begin an embossing sequence, the operator manually positions a card 230 so that its lower edge rests in an appropriately dimensioned slot of lower card emplacement guide 231 and its upper portion is located behind inverted T 41.

After the card is in place, the operator moves card insertion ram 44 to the left so that the inserting finger 233 comes to rest against the lower right hand corner of the blank card. By continuing to slide the card insertion ram 44 inwardly, the card 230 is inserted to the position shown in the drawing by card 235.

As the card is inserted, it is aligned between the entry plates 185, 186 of the card entry guide shown in FIG. 10. As it exits from the entry plates, it begins to enter the slots of the card guides 120, 121 shown in FIG. 11. Also, as it emerges from the entry plates, the innermost edge impacts against a finger 236 depending from card registration link 237. The card registration link is slidably mounted in the upper horizontal transport tube and is urged to the right in the Figure by spring 238. As the card is completely inserted, it moves to the position shown by card 235 causing the card registration link 237 to move to the position shown at the left side of FIG. 12. The card continues to move inwardly until it passes card registration leaf spring 240. While the card is being inserted, the card registration leaf spring is pivoted out of the way. As the card passes, it snaps behind the rear edge of the card. The card is then located at the appropriate position to be embossed by the first selected character.

As previously described, as each character is embossed in the card, because of the rolling-squeezing process of embossing, a velocity is imparted to the card equal, at its maximum, to the tangential velocity of the embossing wheel. The effect of the imparted velocity is to cause movement of the card to the left in FIG. 12 against the action of registration link spring 238 and away from the edge of the card registration leaf spring 240. When the card is released by the embossing molds as they revolve away from each other, it is returned to abut the edge of the card registration leaf spring 240 by the action of the card registration link 237 and the spring attached thereto.

As successive characters are embossed, the entire card transport mechanism of FIG. 12 is indexed one character space per embossed character as previously described. The entry plates 185, 186 and card registration leaf spring 240 all move with the card in the card transport mechanism.

Figure 13:
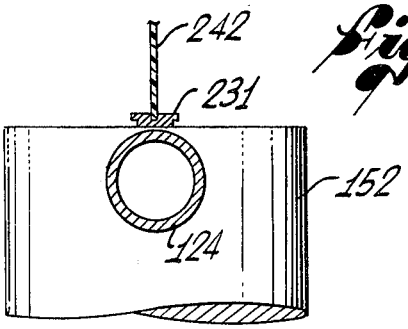
FIG. 13 is a section view taken along the lines 13—13 of FIG. 12 showing a portion of the lower card emplacement guide.

FIG. 13 is a section view taken along the lines 13—13 of FIG. 12. The slotted lower card emplacement guide 221 is shown with a card 242 in place. The purpose of the card emplacement guide, as previously described, is to align the lower part of the card for proper insertion between the 185, 186 of the card entry guide.

Figure 14:
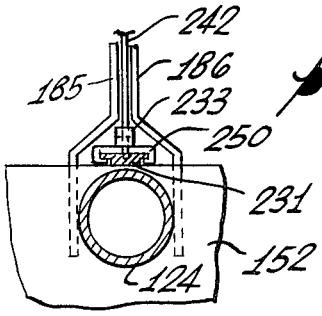
FIG. 14 is a section view taken along the line 14—14 of FIG. 12 of the card input portion of the embossing machine of this invention showing the lower card emplacement guide, a part of the card entry guides and the end of the card insertion ram.

FIG. 14 is a section view taken along the section lines 14—14 of FIG. 12. The lower card emplacement guide 231 is shown with a card 242 in place. In addition, the card insertion ram 250, to which the inserting finger 233 is attached, is shown. As previously described, as the card insertion ram pushes the card inwardly, it passes between plates 185, 186 of the card entry guide. The purpose of the plates is to insure that the card properly enters the slots of the horizontal guides 120, 121 shown in FIG. 11.

Figure 15:
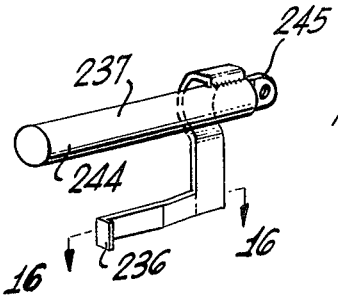
FIG. 15 is a perspective view of the card registration link.
Figure 16:
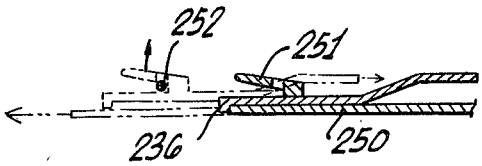
FIG. 16 is a section view of the upper horizontal card guide showing the position of the card registration link showing operation of the release pin for ejecting an embossed card.

FIG. 15 is a perspective view of the card registration link 237 shown in FIG. 12. The upper cylindrical portion 244 travels horizontally in the upper horizontal transport tube as shown in FIG. 16. The registration link spring is attached to the link through aperture 245 and urges the card registration link to the right in FIG. 12. As described in connection with FIG. 12, the card is inserted in the machine and impacts against finger 235 depending from the cylindrical body of the card registration link.

As successive characters are embossed, the card transport mechanism and the card moves from the operator's right in the machine.

After a card is embossed, an eject pulse is entered either on a keyboard or from any data source. The eject pulse simply repeatedly energize the escapement mechanism of FIG. 3(*a*) and causes the card transport mechanism and the card to travel to its extreme left. At that point, a ramp located on the back face of the card registration link causes the link to be pulled away from the card so that the card may be withdrawn. Operation of this function is seen in FIG. 16. The card 250 is shown in the right hand portion of the Figure as restrained from further movement to the left by finger 236. The ramp 251 located on the reverse side of the card registration link has no affect on the travel on the card transport mechanism until the ramp strikes a release pin 252 which depends from the cover the embossing machine. The inclination of the ramp 251 and the positioning of the release pin is such that the card registration link is pulled away from the card. Thereafter, the completely embossed card may be withdrawn from the horizontal card guides. The release pin may also be seen in FIGS. 3, 4 and 5.

Figure 17:
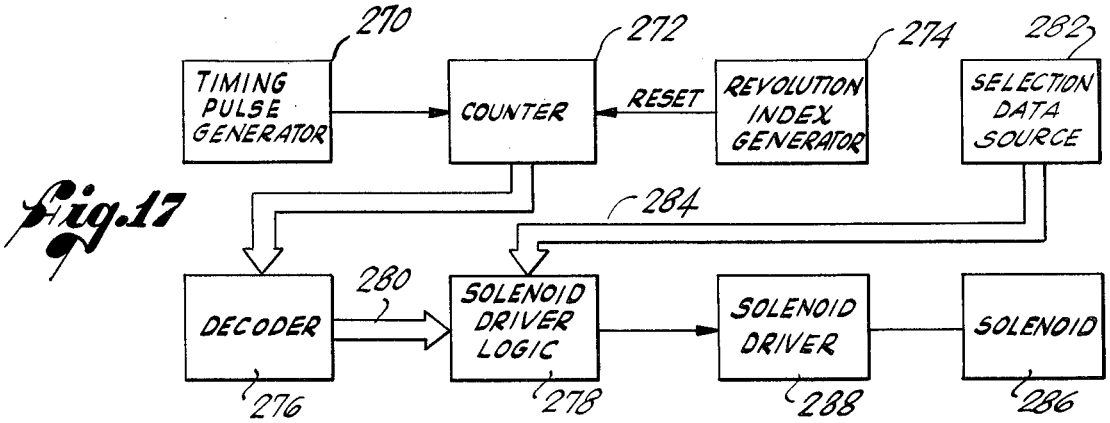
FIG. 17 is a block diagram of the electronic control circuit of this invention.

The electronic control circuitry of this invention is shown in FIGS. 17 to 22. Referring to FIG. 17, a timing pulse generator 270 senses the angular position of the embossing wheels by generating a pulse upon passage of each gear tooth of the ring gear attached to one of the embossing wheels. The position of the timing pulse generator in relation to the embossing wheel ring gear may be seen in FIG. 3. Any such sensor capable of determining magnetic changes by the near rotation of gear teeth may be used. In the preferred embodiment a magnetic sensor manufactured by Airpax Electronics, Fort Lauderdale, Florida, as Model No. 4-0008, is utilized. Also, as may be readily appreciated, different types of sensors, such as optical, may also be employed.

Timing pulse generator 270 produces output pulses, one pulse upon the passage of each tooth of the embossing wheel ring gear. The generated pulses are fed serially to a counter 272. The counter is a resetable eight-stage counter which develops, on eight output lines, a parallel digital representation of the numbers of pulses produced by timing pulse generator 270.

The revolution index generator 270 produces a pulse once during each revolution of the embossing wheels. As shown in FIG. 3, the revolution index generator senses passage of a small magnetic block attached to the side of one of the ring gears. As is the case with the timing pulse generator 270, a number of different sensing devices may be used as the revolution index generator. In the preferred embodiment, the Airpax device identified above is employed. Each pulse generated by the revolution indes generator 274 is used to reset the eight-stage counter to zero. Accordingly, the output of the counter 272 begins at zero when reset by the revolution index generator 274 and increments by one count for each tooth which passes the timing pulse generator 270. The counter continues to increment until it is again reset to zero following one complete revolution of the embossing wheels.

Figure 20:
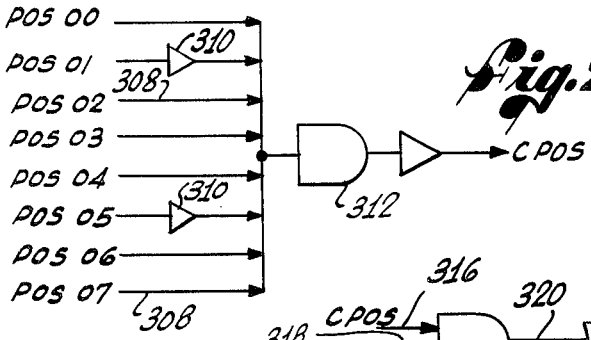
FIG. 20 is a diagram of the logic circuitry module for each embossing character which may be selected.

The parallel output of the counter 272, consisting of eight lines, is applied to a decoder 276. The decoder consists of a plurality of modules, one of which is shown in FIG. 20. There are as many modules as there are different characters available on the embossing wheels for embossing. Each module of the decoder 276 is supplied the identical eight line output of the counter 272. As will be better understood by reference to the description of FIG. 20, below, each module comprises and AND gate which develops an output when a unique predetermined digital number appears on the counter output lines. Every single digital number of the counter 272 which represents a character to be embossed will cause one module of the decoder 276 to develop an output.

It should be understood that there is not a one-to-one correspondence between the gear teeth of the embossing wheel ring gear and the number of embossing molds. For example, it may occur that the dimensions of the embossing wheel and the number of teeth per inch of the ring gear are such that four gear teeth will be counted for each embossing mold located on the embossing wheel. In such a case, only one-forth of the digital numbers which may appear on the output of counter 272 will cause one of the modules of the decoder 276 to turn on its output line.

Outputs of the decoder 276 are applied to solenoid driver logic 278 via output line 280. There are as many lines in the parallel output 280 of the decoder as there are characters which may be embossed. The details of the solenoid driver logic will be described in connection with FIG. 21.

A second input to the solenoid driver logic is produced by the selection data source 282 over parallel lines 284. As with the output of the decoder 280, there are as many lines in the parallel output of the selection data source as there are characters which may be embossed.

In the preferred embodiment disclosed herein, the selection data source 282 consists of a manual keyboard. In such an embodiment, each key of the manual keyboard would be used to turn on a single output line when the key is depressed by an operator. However, the selection data source, as previously described, may take the form of any properly formatted source of data. For example, alpha-numeric signals are ordinarily represented on a magnetic tape by a multi-bit code. If such a magnetic tape were to be used as the selection data source, it would only be necessary to serially read the multi-bit codes and convert them to single line outputs. That is, when a multi-bit code would be sensed indicating the letter M, simple decoding circuitry would recognize the code and turn on the single one of the plurality of lines 284 representing an M to be embossed.

Solenoid driver logic 278 also comprises as many logic modules as there are characters to be embossed. Each module (shown in detail in FIG. 12) comprises an input AND gate supplied with one of the decoder output lines and one of the selection data source output lines. Continuing the above example of selection data source 282 providing an output for an M, the M line is applied to the input of the same AND gate which receives the input indicating that the M embossing mold is approaching the actuating solenoids.

When any one of the AND gates of solenoid driver logic 278 finds both of its inputs on, actuating solenoid 286 is energized by the solenoid driver 288.

Figure 18:
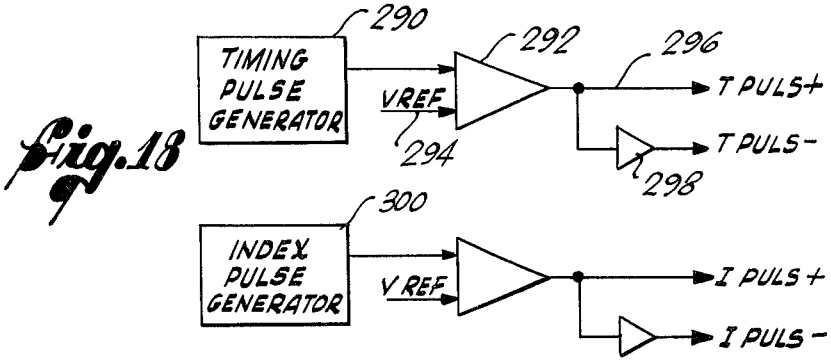
FIG. 18 is a block diagram of a portion of the circuitry showing formation of certain pulses used in the logic circuitry.

Referring to FIG. 18, further details of the circuits of the timing pulse generator and revolution index generator are disclosed. Both circuits are substantially identical so only one will be described. The timing pulse generator 240 is the Airpax unit described above. Its output is fed to an amplifier 292 which is also supplied with a second reference voltage input 294. The purpose of the amplifier 292 is to insure that the logic circuit inputs developed by the generating devices are always of the same amplitude. The output of the amplifier 202 appears on line 296 and is used as the positive timing pulse. A branch of the output of the amplifier is inverted via standard inverter 298 and used as outputs are developed by identical circuitry for the revolution index generator 300.

Figure 19:
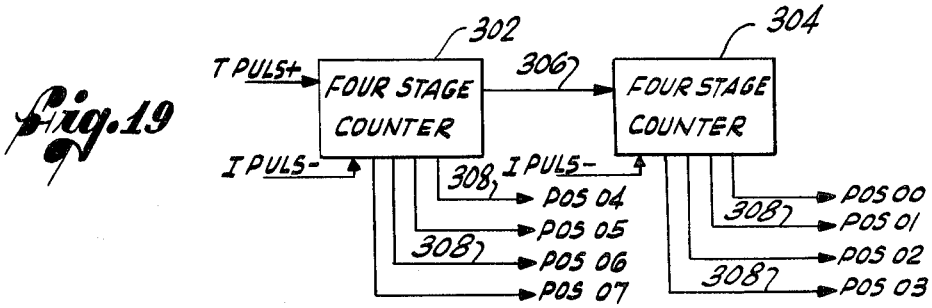
FIG. 19 is a block diagram of two cascaded four stage counters of this invention used to form a digital representation of the angular position of the embossing wheels.

Details of the counter are shown in FIG. 19. The eight stage counter 272 of FIG. 17 consists, in the preferred embodiment, of two cascaded four stage counters. Any readily available eight stage counter or cascaded four stage counters may be used for this purpose. In the preferred embodiment, an integrated circuit four stage counter manufactured by Signetics, Inc., as Model 74161 was utilized. The eight stages are made up of two identical four stage circuits 302, 304. They are cascaded by an output line 306 which provided the input to the second four stage counter 304. As previously described, the counter develops digital signals on eight parallel output lines 308.

Referring to FIG. 20, one of the modules of decoder 276 is shown. It should be remembered that they are as many modules as there are characters which may be embossed. Each module is identical except for the placing of inverters, such as 310, in its input. Each module is provided with eight parallel output lines 308 of the counter 272. The eight outputs of the counter are applied as the input to an AND gate 312. The AND gate will develop an output only when all of the inputs supplied to it are the same. By predetermining the digital number appearing on the output of counter 272 (FIG. 17) which indicates that a given embossing mold is in the proper position for selection, a pattern of inverters 310 may be appropriately placed on the input to AND gate 312. For example, if the output of counter 272 had a digital number 10111011, the inverters 310 would change the zeros to ones and the AND gate 312 would develop an output indicating the approach to the mold setting solenoids of the predetermined embossing molds.

It should be understood that each module as shown in FIG. 20 will develop one output upon one complete revolution of the embossing wheel, assuming that there is only one set of embossing characters on each wheel. The outputs of the modules of FIG. 20 simply indicate that the corresponding embossing molds are approaching the actuating solenoids.

Figure 21:
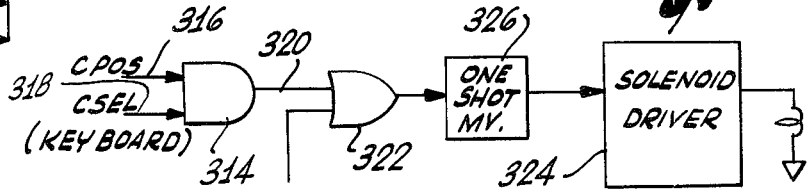
FIG. 21 is a block diagram of the solenoid driver circuit for energizing the actuating solenoids.

FIG. 21 discloses detail of the solenoid driver logic 278. There are as many modules in the solenoid driver logic as there are embossing characters which may be selected. As shown in FIG. 21, each module comprises an AND gate 314 supplied with the output of one of the modules of FIG. 20 and one of the lines from the selection data source 282. When both lines are turned on, a certain character has been selected for embossing and the embossing mold of that character is in a proper position for selection by the mold setting solenoids. In that case, the AND gate output line 320 is turned on. The outputs of each of the AND gates of all of the modules of solenoid driver logic 278 (FIG. 17) are applied via an OR gate 322 to a solenoid driver 324 via a one-shot multivibrator 326. The multivibrator simply assures that a pulse of the proper duration is supplied to the solenoid driver.

Any solenoid driver could be used. The preferred embodiment utilizes a driver assembly manufactured by Unitrobe, Inc., Watertown, Massachusettes, as Model No. PIC-4101 B. When the one-shot multivibrator 326 turns on its output line to the solenoid driver 324, the actuating solenids are energized. This causes the mold cam levers of the selected embossing molds to be retoated behind the molds, forcing the two selected molds to an outward position for embossing.

Figure 22:
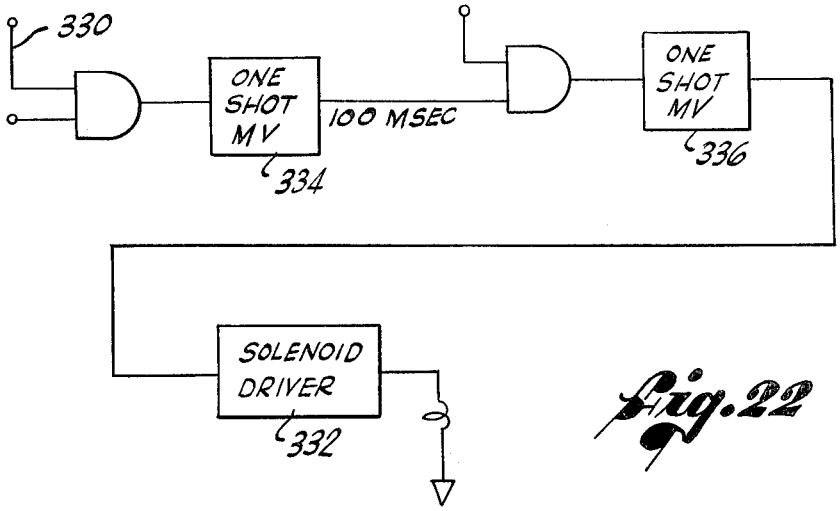
FIG. 22 is a block diagram of the solenoid driver circuit for energizing the escapement solenoid.

Referring to FIG. 22, circuitry for the actuation of the escapement solenoid is shown. Input pulses are received by the circuitry over line 330. Line 330 may be energized from a number of sources, such as a space bar on the keyboard of the embodiment disclosed herein or each key of the keyboard. The escapement is indexed for embossing of a next successive character. The solenoid driver 332 operates from two cascaded one-shot multivibrators 334, 336. The multivibrators ae used to obtain the appropriate length pulse for operation of the solenoid driver. The solenoid uitlized for this purpose in the preferred embodiment is identified in connection with the description of FIG. 21, above.

Subsequent to the development and successful operation of the above-described embosser, an improvement in the embossing mold selection mechanism and method was developed. The improved selection system, now considered the preferred embodiment, will be described below and constitutes the new subject matter of this continuation-in-part application.

Figure 23:
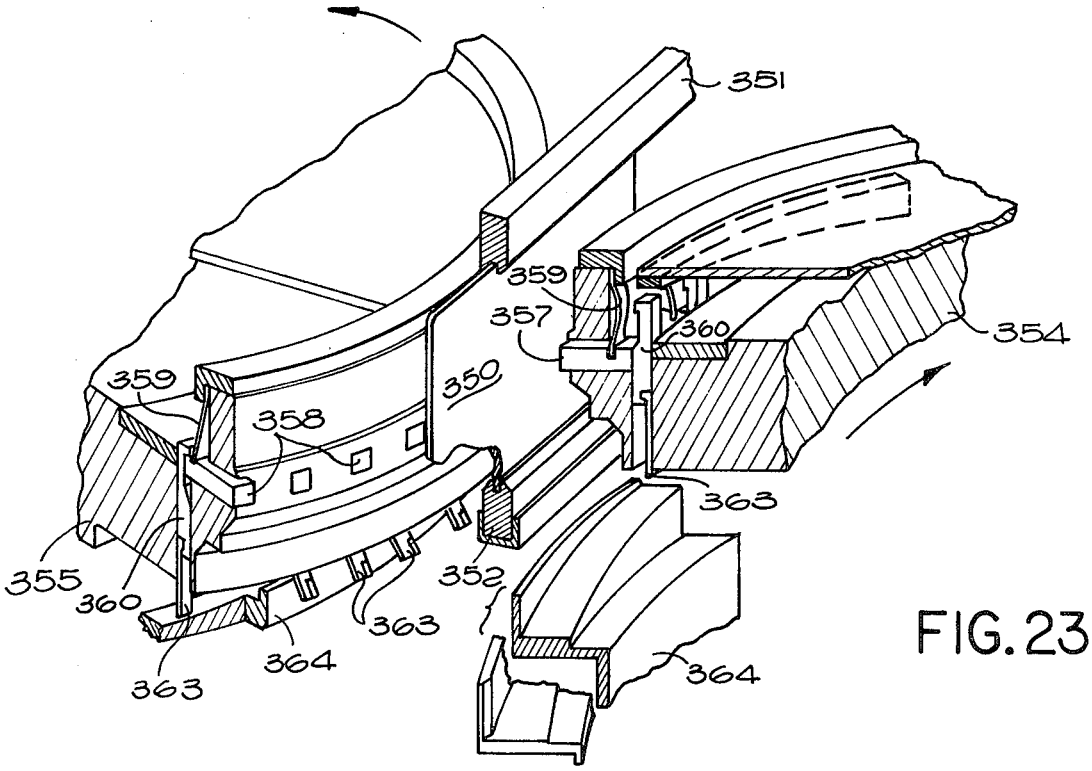
FIG. 23 illustrates the embossing principle of this invention, in the same manner as does FIG. 2, including the embossing mold selection means of the preferred embodiment.

FIG. 23 illustrates (in similar fashion to FIG. 2) the basic operating principle of the selection system of the preferred embodiment. A card to be embossed 350 is held by upper and lower horizontal card guides 351, 352. The card transport mechanism utilized in the preferred embodiment is unchanged from that previously described and is not, therefore, shown in detail.

The card 350 is positioned between the two previously described constantly rotating embossing wheels 354, 355. As before discussed, each embossing wheel contains radially movable embossing molds 357, 358. Under non-selected conditions, each embossing mold is urged radially inwardly by leaf springs 359.

Positioned behind each embossing mold is a vertically movable mold cam 360. When a mold cam 360 is in its downward position (as shown in wheel 355), the associated embossing mold rests in a detent in the outer face of the mold cam and is in its radially inward position. When a mold cam 360 is in its upward position (as shown in wheel 354), the associated embossing mold has been cammed outwardly to its extended position for embossing. The selection, then, of an embossing mold is accomplished by vertically raising the associated mold cam.

Depending downwardly from each mold cam 360 is a mold cam stem 363. In the preferred embodiment, the mold cams 360 are made of steel while the mold cam stems 363 are fabricated of a high density material such as Nylon.

Positioned before the embossing point and below the rim of each embossing wheel are stem ramps 364. As will be shown in detail in connection with the discussion of later figures herein, rotation of the embossing wheels 354, 355 and the resulting centrifugal forces cause the lower ends of the mold cam stems to pivot outwardly and pass outside the stem ramps 364. By a method to be first described in connection with FIG. 25, selection of a particular embossing mold and character is initiated by forcing the lower end of the associated mold cam stem inwardly so that it strikes the stem ramp 364. As a result, the mold cam stem slides up the stem ramp, serving to raise the mold cam to which it is connected which, in turn, cams the associated embossing mold outwardly.

Figure 24:
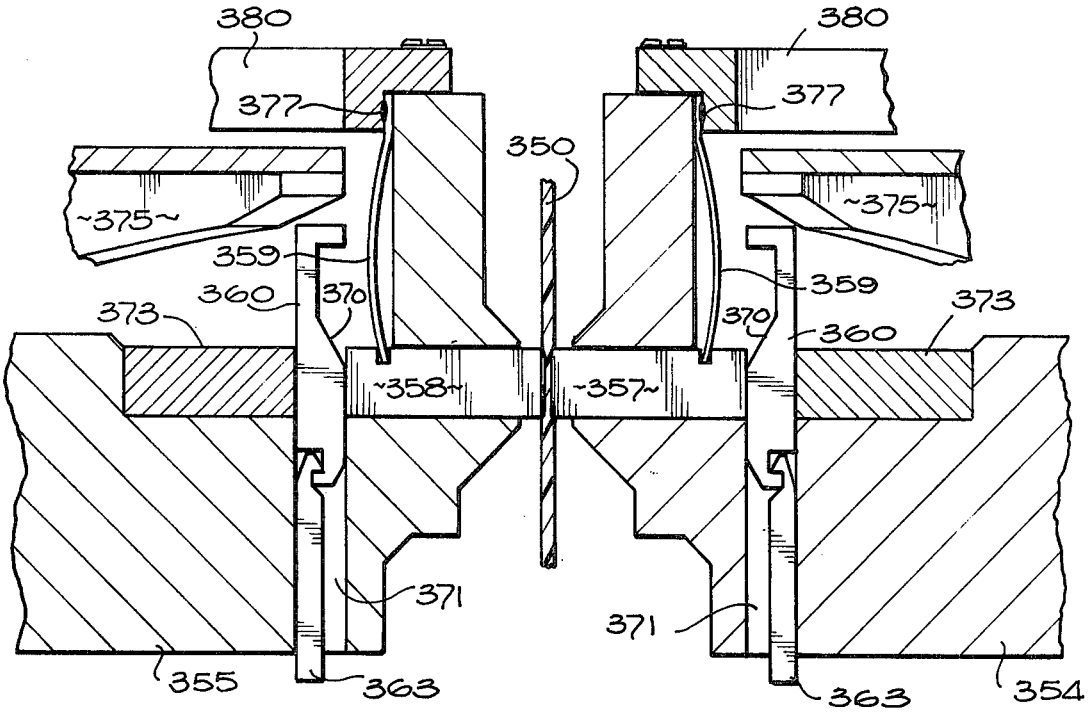
FIG. 24 is an enlarged sectional view of the embossing mold selection means of the preferred embodiment, illustrating the embossing of a character by the selected male and female embossing molds.

The relative positions of the embossing mold components of the preferred embodiment may be seen in FIG. 24, wherein a pair of embossing molds have been selected and are embossing a character in card 350.

Prior to the components assuming the positions of FIG. 24, the mold cam stems 363 were forced upwardly by riding on stem ramps 364. Mold cams 360 also moved upwardly, causing, via their cammed faces 370, the associated embossing molds 357, 358 to move outwardly to their embossing positions as shown.

As may be appreciated, mold cams 360 and mold cam stems 363 move vertically within cavities 371, sized so as to allow easy movement but to also insure that the mold cams and mold cam stems cannot pivot about a radius of the embossing wheels.

As previously described, a backup ring 373 is provided on each embossing wheel to absorb the forces transmitted by the act of embossing.

Following embossing, the upper faces of the mold cams 360 rotate into return ramps 375 which force them downwardly. Leaf springs 359, spot welded to the body of the embossing wheels at 377 and further locked into place by cap ring 380, urge the embossing molds radially inwardly to their original, non-selected positions.

Figure 25:
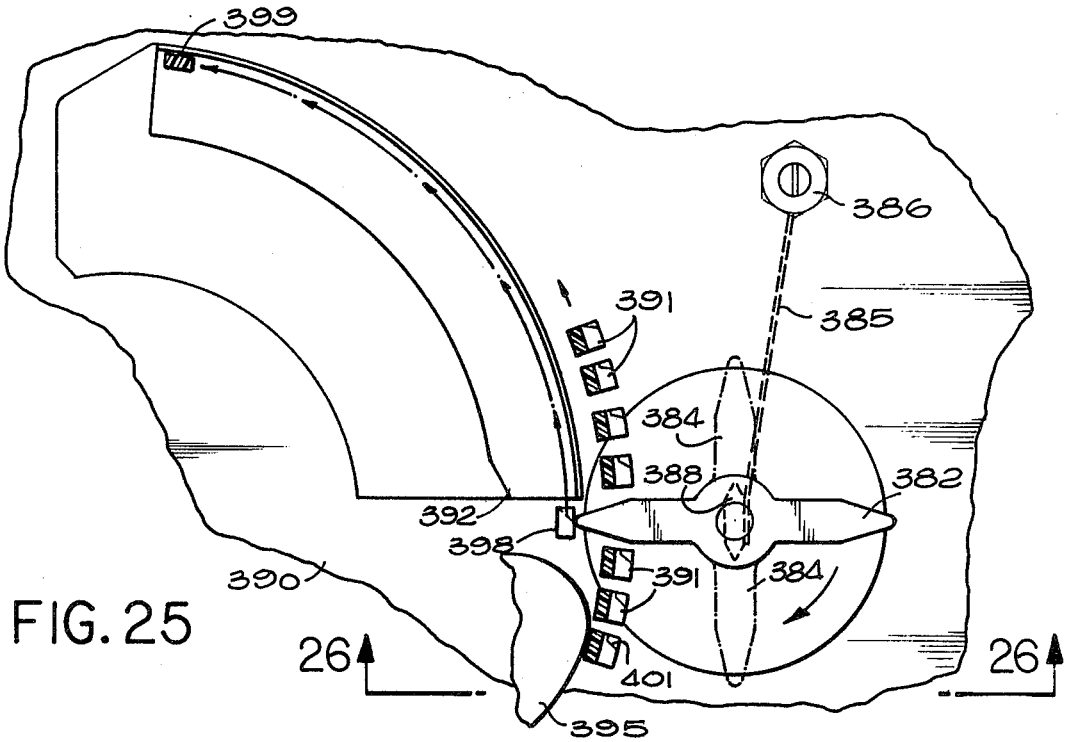
FIG. 25 illustrates the selection of a cam lever stem of the preferred embodiment by the stepping motor impeller, serving to displace the stem inwardly to ride up the cam ramp.

FIG. 25, a vertical view of one embossing wheel, illustrates the method used in the preferred embodiment to select a particular embossing mold. Placed approximately ninety degrees before the embossing point on each embossing wheel is an impeller 382 driven by a stepping motor (shown in FIG. 26). When not energized, the two bladed impeller is in the park position shown by the dotted outline 384. The park position is determined by spring 385 attached to the embosser base by bolt 386 riding against projections 388 on the lower end of the armature of the stepping motor.

When no character has been selected for embossing, the impeller is in its park position 384 and the embossing wheel 390 is rotating. The mold cam stems are in their downward positions and are pivoted outwardly by centrifugal force, as shown by mold cam stems 391. Accordingly, the lower ends of the mold stems pass by the outer side of the stem ramp 392 and do not ride up the ramp.

Because it may sometimes occur that a non-selected mold cam stem could stick and not be pivoted outwardly by centrifugal force, a cammed surface 395 is provided ahead of the entry point to stem ramp 392. As each mold cam stem passes cammed surface 395, then, it is mechanically pivoted outwardly to the point that, if nothing further occurs, it will pass outside the stem ramp 392.

When selection of a particular embossing mold is made, a stepping motor causes impeller 382 to rotate in a clockwise direction in FIG. 25 so that it will strike the associated mold cam stem 398 and cause it to pivot inwardly. As described, the mold cam stem then strikes the stem ramp 392 and begins its vertical travel. A previously selected mold cam stem 399 is shown at the top of the stem ramp 392. In the preferred embodiment, timing requirements have been found to be such that successively selected embossing molds must be at least fourteen embossing mold positions apart.

Figure 26:
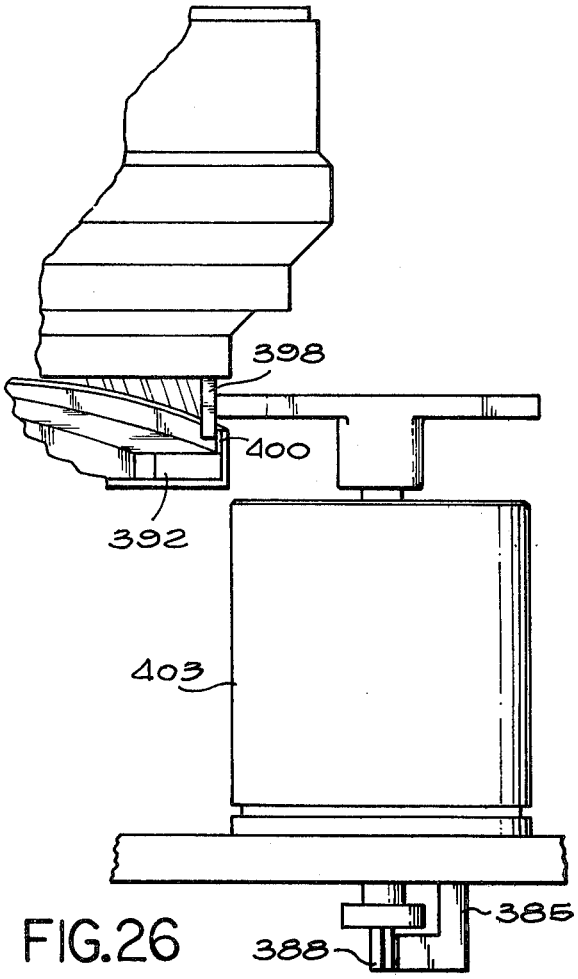
FIG. 26 is a sectional view of the stepping motor impeller and selected cam lever stem taken along the lines 26—26 of FIG. 25.

FIG. 26 is a side view of the impeller of FIG. 25 as it causes mold cam stem 398 to pivot inwardly to begin its ride up the stem ramp 392. It should be noted that the vertical entry of the cam ramp 392 is bevelled at 400. Similarly, the facing edge of the mold cam stem is bevelled at 401 (FIG. 25). In this way, assurance is obtained that the stem will not collide with and break against the stem ramp 392.

FIG. 26 also illustrates the mounting of stepping motor 403. In the preferred embodiment, a Series 1503V20 motor manufactured by General Provision Industries, Anaheim, Calif., is used. Any similar motor, of course, could be utilized. It is only necessary that the speed characteristics of the motor be such that the tangential speed of the impeller tip at the time of impact against the mold cam stem to be the same as the tangential speed of the embossing wheel.

Figure 27:
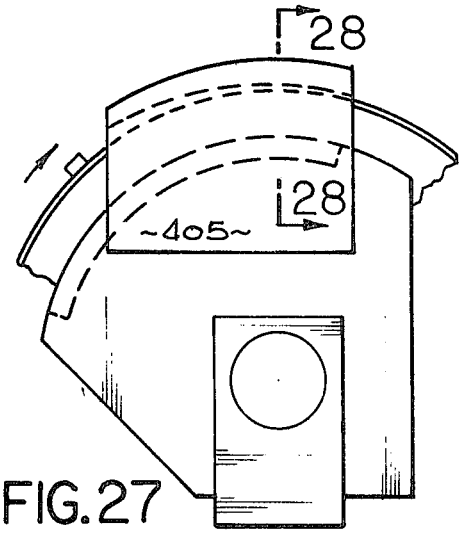
FIG. 27 is a top view of a return cam of the preferred embodiment used to move previously selected embossing molds inwardly following the embossing step in the event the return spring has not forced the embossing molds to their original position.
Figure 28:
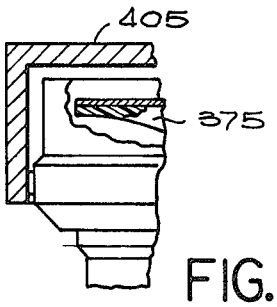
FIG. 28 is a sectional view taken along the lines 28—28 of FIG. 27 illustrating the return cams for the mold cam levers and previously selected embossing molds.

Following the embossing step, as previously described, the selected embossing molds project radially outwardly from the embossing wheels. A return ramp 375 (FIG. 24) moves the mold cams downwardly, freeing the embossing molds to be moved inwardly by the associated leaf spring. In the event, however, that an embossing mold sticks in its outward position, a return cam 405 is provided, as shown in FIGS. 27 and 28. As illustrated, the return cam strikes the outer face of the extended embossing mold, forcing it to its inward position. The positions of the return cam 405 (FIG. 27) and the return ramp 375 about the embossing wheels are such that the mold cams are moved downwardly before the embossing molds are returned inwardly.

Figure 29:
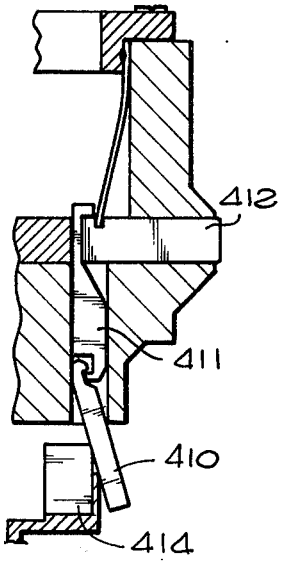
FIG. 29 is a view of one embossing mold and its associated selection means of the preferred embodiment. The embossing mold is illustrated as non-selected; consequently, the cam lever stem is pivoted outwardly and the embossing mold is held in its inward or retracted position.
Figure 30:
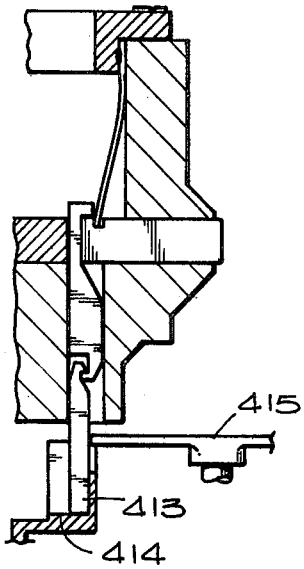
FIG. 30 is a view similar to FIG. 29, illustrating a selected cam lever stem of the preferred embodiment as it is selected and urged inwardly by the stepping motor impeller.
Figure 31:
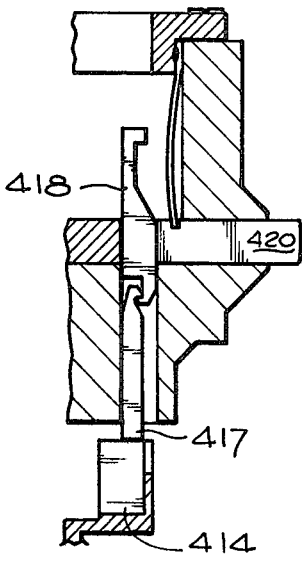
FIG. 31 is a further view similar to FIG. 29, showing the selected embossing mold in its outward position and the cam lever stem and cam lever in their raised positions.

FIGS. 29, 30 and 31 illustrate the operation of the mold cams and mold cam stems. As shown in FIG. 29, nonselected mold cam stems 410 are pivoted outwardly away from the stem ramp 414. The associated mold cam 411 is held, thereby, in its downward position and the embossing mold 412 in its inward position.

As illustrated in FIG. 30, a selected mold cam stem 413 is pivoted inwardly by the stepping motor impeller 415. The vertical mold cam stem is then positioned to enter the stem ramp 414.

After the mold cam stem rides up the stem ramp, the mold cam stem 417 and mold cam 418 are in their upward positions as shown in FIG. 31. The associated embossing mold 420 is thereby forced outwardly to be in position for embossing.

As previously described in connection with prior Figures, the angular position of the embossing wheels is constantly sensed. In the original embodiment, the angular position was sensed by detecting the change in a magnetic field caused by gear teeth passing a detector.

Figure 32:
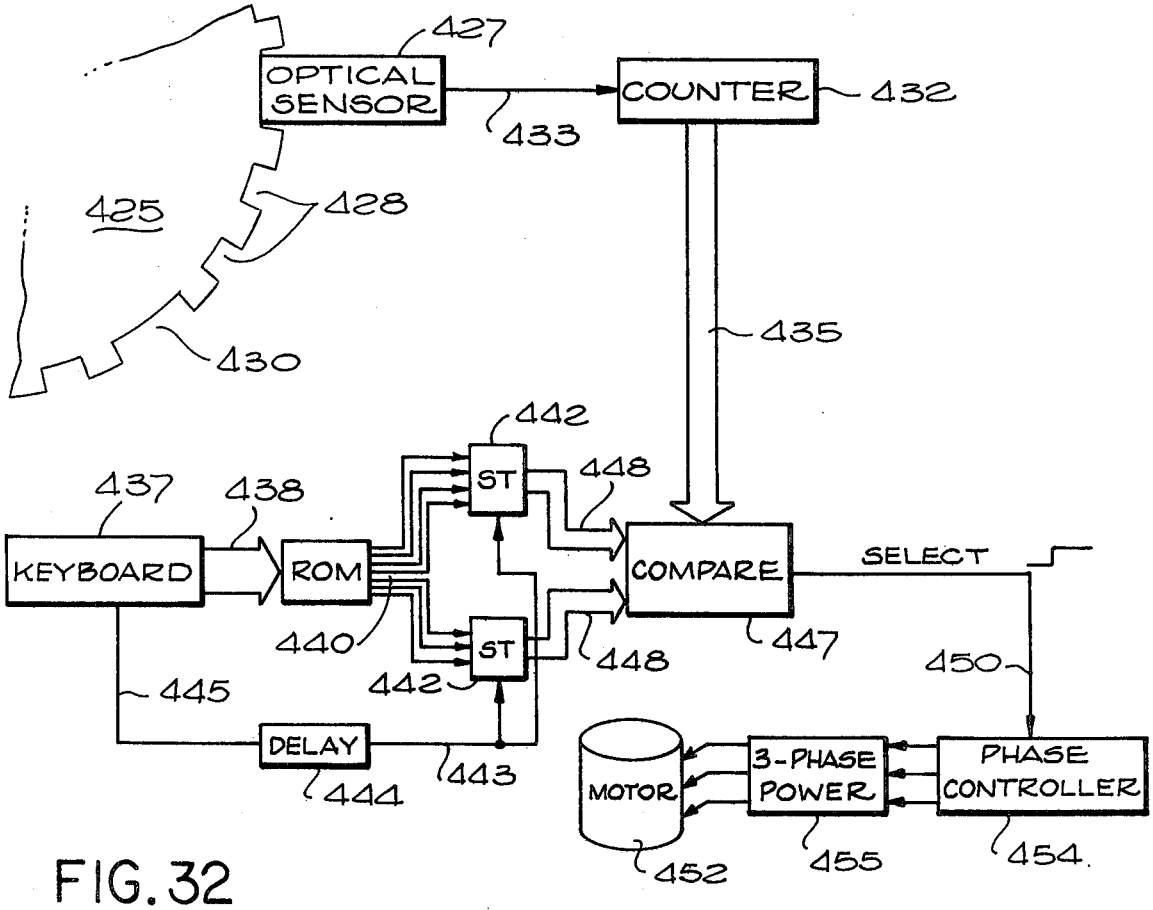
FIG. 32 is a diagram of one electrical embodiment used to control the stepping motor.

In the preferred embodiment, an optical sensing arrangement is utilized. Referring to FIG. 32, a slotted disk 425 is concentrically attached to either of the two embossing wheels. As the wheels turn, then, the disk 425 turns in near contact with an optical sensor 427.

Spaced around the periphery of the disk 425 are slots, such as shown at 428. The optical sensor develops, in well-known fashion, a pulse output caused by the detected differences in an optical path between the presence of a tooth of the disk or a slot.

One slot 430 is slightly larger than the rest. The difference in relative size has been exaggerated in FIG. 32 for clarity. Detection of slot 430 by the optical sensor 427 results in a longer pulse which is used to reset the counter 432.

Any multi-stage resettable counter could be used to count the output pulses developed by the optical sensor 427. In the preferred embodiment, the counter utilized is Model 74160 Synchronous Decade Counter manufactured by Signetics Corporation, Sunnyvale, Calif. The counter accepts serial pulses from the optical sensor 427 via input line 433 and develops a current count code on parallel lines 435. Detection of the larger slot 430 causes the counter 432 to reset to a zero count after a full revolution of the embossing wheels.

Parallel lines 435, then, carry a digital signal constantly representing the current position of the embossing wheels.

As in the original embodiment, characters to be embossed may be entered via a manual keyboard 437. The keyboard, of standard design, generates an electrical output on parallel lines 438. The output, of course, is unique to each different character entered.

It should be understood that in this preferred embodiment, character signals may originate from any type source, of which a keyboard is but one example. For example, character signals may appear on lines 438 from sources such as magnetic tapes, core memories, disc memories, video terminals, and so forth.

The line 438 signals must be converted into a character selection code which matches, in format, the wheel position code which appears on lines 435. There are, of course, numerous ways this conversion can be made. In the preferred embodiment, a programmable Read Only Memory (ROM) is utilized. The ROM is a device which a user can "program" to generate a selected output each time an expected input is received. The ROM output appears on lines 440 and represents the converted code of the character to be embossed.

Lines 440 are applied to multi-stage storage registers 442. The converted character code is held in the storage registers until enabling line 443 is turned on.

Generally, Read Only Memory devices are slow to develop outputs. In order to assure that the character codes are inputted into the system at predetermined times after entry on the keyboard, a delay device 444 is used. When any character key on the keyboard 437 is depressed, a pulse appears on line 445. The delay device 444 allows time for the ROM to completely develop its output and load the storage registers 442. Thereupon, enabling line 443 turns on and causes the contents of the registers to be supplied on the second input to comparator 447 via lines 448.

Comparator 447 is of standard design and develops an output (select) signal upon determination that the two inputs match. The select signal, then, appears on line 450 when the comparator determines that the position of the embossing wheels is such that a character entered for embossing may be selected by the stepping motor.

The stepping motor 452 must be started and rotated at a speed equal to the tangential velocity of the embossing wheels. As explained above, various embossing wheel speeds have been used successfully. The motor utilized in the preferred embodiment is three phase. It is powered by a standard three phase power source 455. The power source, in turn, is switched on for a period necessary to bring the motor to its proper speed by standard phase controller 454. The phase controller serves as a simple switch to turn on and hold on the three phase power supply for the necessary length of time to bring the motor 452 to its necessary speed. The three phase power supply and power controller are standard circuit units readily available. As with the motor and other circuit components, this invention contemplates use of any one of the many equivalent three phase power circuits presently on the market.

What we claim is:

1. In a machine for embossing characters in flexible sheets, the combination comprising, first and second embossing wheels mounted for coplanar synchronous rotation about constantly spaced adjacent parallel axes, with their peripheries spaced apart a distance greater than the thickness of said flexible sheets, first and second corresponding sets of embossing molds respectively mounted about the peripheries of said first and second embossing wheels, means for moving during rotation of said wheels a selected matching pair of embossing molds, one of said pair from each of said first and second sets, along radii of said wheels to extend radially outwardly from said embossing wheels, whereby a character borne by the selected matching pair of embossing molds is embossed in a flexible sheet placed between the embossing wheels.

2. The embossing machine of claim 1, further comprising, first and second meshing ring gears respectively mounted about said first and second embossing wheels, and, means for constantly rotating said first and second embossing wheels.

3. The embossing machine of claim 2, wherein said means for constantly rotating comprises an electric motor having a gear on its armature shaft meshing with one of said ring gears.

4. The embossing machine of claim 1, further comprising a machine base plate to which is attached first and second upwardly extending cylindrical shafts, and, wherein said first and second embossing wheels comprise first and second circular disks respectively rotatably mounted on said first and second upwardly extending shafts.

5. The embossing machine of claim 4, further comprising, first and second meshing ring gears respectively mounted about said first and second circular disks, and, means for constantly rotating said first and second circular disks.

6. The embossing machine of claim 5, wherein said means for constantly rotating comprises an electric motor having a gear on its armature shaft meshing with one of said ring gears.

7. The embossing machine of claim 1, wherein, each of said embossing wheels includes radially extending cavities located about its periphery, and, wherein each of said sets of embossing molds comprises a plurality of mold bodies, each body bearing on its outer face the representation of a character for embossing and mounted in one of said cavities for selective radial movement from a first position relatively toward the axis of said embossing wheel in which it is mounted to a second position extending radially outwardly from said embossing wheel.

8. The embossing machine of claim 7, wherein, said radially extending cavities comprise equally spaced rectangular holes placed in the outer rim of each of said embossing wheels, and, each of said mold bodies comprise rectangular blocks mounted in one of said rectangular holes.

9. The embossing machine of claim 1, further comprising a machine base plate to which is attached first and second upwardly extending cylindrical shafts, wherein said first and second embossing wheels comprise first and second circular disks respectively rotatably mounted on said first and second upwardly extending shafts, first and second meshing ring gears respectively mounted about said first and second circular disks, means for constantly rotating said first and second circular disks, wherein each of said circular disks include radially extending cavities located about its periphery, and, wherein each of said sets of embossing molds comprises a plurality of mold bodies, each body bearing on its outer face the representation of a character for embossing and mounted in one of said cavities for selective radial movement from a first position relatively toward the axis of said disk in which it is mounted to a second position extending radially outwardly from said disk.

10. The embossing machine of claim 9, wherein said means for constantly rotating comprises an electrical motor having a gear on its armature shaft meshing with one of said ring gears.

11. The embossing machine of claim 9, wherein said radially extending cavities comprise equally spaced rectangular holes placed in the outer rim of each of said first and second circular disks, and, each of said mold bodies comprise rectangular blocks mounted in one of said rectangular holes.

12. The embossing machine of claim 1, wherein, each of said first and second embossing wheels include radially extending cavities located about its periphery, each of said sets of embossing molds comprises a plurality of mold bodies, each body bearing on its outer face the representation of a character for embossing and mounted in one of said cavities for selective radial movement from a first position relatively toward the axis of the embossing wheel in which it is mounted to a second position extending radially outwardly from said embossing wheel, and, said means for moving comprises a plurality of cam means each operable against the face of one of said mold bodies nearest the axis of the embossing wheel on which it is mounted.

13. The embossing machine of claim 12, wherein each of said cam means comprises a lever rotatable about a radius of said embossing wheel from a first position free of said mold body to a second position against the face of the mold body nearest to the axis of the embossing wheel on which it is mounted, whereby the said mold body is cammed outwardly along a radius of said embossing wheel.

14. The embossing machine of claim 13, further comprising means to rotate each of said cam means from said first position to said second position.

15. The embossing machine of claim 14, wherein said means to rotate each of said cam means comprises an electrical solenoid.

16. The embossing machine of claim 12, wherein each of said cam means is mounted for movement parallel to said parallel axes from a first position to a second position for causing, when in said second position, said selected matching pair of embossing molds to extend radially outwardly from said embossing wheels.

17. The embossing machine of claim 16, further comprising ramp means mounted below each of said embossing wheels for slidably contacting said cam means to move said cam means from said first position to said second position.

18. The embossing machine of claim 16, wherein said cam means comprises first means having a shape relatively thin at its upper end and relatively thick at its lower end, and, second means depending from said first means and free to pivot through arcs along radii of said wheels so that the lower ends thereof may move between a first inward position along said radii and a second outward position along said radii.

19. The embossing machine of claim 18, further comprising ramp means mounted below each of said embossing wheels for slidably contacting the lower ends of said second means when said second means are in said first inward position.

20. The embossing machine of claim 19, further comprising selection means for selectively moving said second means from said second outward position to said first inward position.

21. The embossing machine of claim 20, wherein said selection means comprises impeller means for rotating from a rest position to an impact position for moving said second means to said first inward position, and, motor means for rotating said impeller means.

22. The embossing machine of claim 1, further comprising means for transporting a flexible sheet to be embossed along perpendicular axes between said embossing wheels.

23. The machine of claim 1, further comprising,
means for sensing the angular position of said embossing wheels and developing an electrical output proportional thereto,
means for generating a unique electrical output determined by the character to be embossed,
means for generating a selection signal when a predetermined relationship between the unique electrical output and the output proportional to the angular position of said embossing wheels is found to exist, and,
means connected to receive said selection signal for causing said moving means to extend said selected pair of embossing molds radially outwardly from said embossing wheels.

24. The machine of claim 23, wherein said means for sensing comprises,
means for generating electrical pulses having a frequency proportional to the speed of rotation of said embossing wheels, and,
digital counter means for generating a binary number corresponding to the number of generated electrical pulses.

25. The machine of claim 23, wherein said means for generating a unique electrical output comprises a manual keyboard having one electrical output line for each different character which may be embossed.

26. The machine of claim 24, wherein said means for generating a selection signal comprises a decoder for generating an output if a pre-determined binary number is found to have been generated by said digital counter means.

27. The machine of claim 26, wherein said means for generating a selection signal comprises a plurality of AND gates, each AND gate connected to receive as its input the output of said decoder and the unique electrical output determined by the character to be embossed.

28. The machine of claim 23, wherein,
said means for sensing comprises
means for generating electrical pulses having a frequency proportion to the speed of rotation of said embossing wheels, and,
digital counter means for generating a binary number of received electrical pulses, and,
said means for generating a unique electrical output comprises a manual keyboard having one electrical output line for each different character which may be embossed.

29. The machine of claim 23, wherein said means connected to receive said selection signal for causing said moving means to extend said selected pair of embossing molds comprises,
cam means mounted between each of the sets of embossing molds and the axis of said embossing wheel on which said molds are mounted, and,
solenoid means energizable by said selection signal for causing said cam means to extend said selected embossing molds.

30. The machine of claim 29, wherein said cam means comprises a plurality of levers mounted for rotation about a radius of said embossing wheel.

31. In a machine for embossing characters in flexible sheets, the combination comprising,
first and second embossing wheels mounted for coplanar synchronous rotation about constantly spaced adjacent parallel axes, each of said wheels including radially extending cavities located about its periphery, said peripheries spaced apart a distance greater than the thickness of said flexible sheets,
first and second corresponding sets of embossing molds, each set comprising a plurality of mold bodies, each of said bodies mounted for movement within one of said cavities, and,
cam means for moving a selected matching pair of embossing molds, one of said pair from each of said first and second sets, from a first position relatively toward the axis of the embossing wheel on which it is mounted to a second position extending radially outwardly from said wheel during rotation of said wheels,
whereby a character borne by the selected matching pair of embossing molds is embossed in a flexible sheet placed between the embossing wheels.

32. The embossing machine of claim 31, wherein each of said cam means comprises a lever rotatable about a radius of said embossing wheel from a first position free of said mold body to a second position against the face of the mold body nearest the axis of the embossing wheel on which it is mounted, whereby the said mold body is cammed outwardly along a radius of said embossing wheel.

33. The embossing machine of claim 32, further comprising first means to rotate each of said levers from said first position to said second position.

34. The embossing machine of claim 33, wherein said means to rotate said levers comprises an electrical solenoid.

35. The embossing machine of claim 32, wherein each of said levers is provided with a cammed surface on the side of the lever adjacent the face of the mold nearest the axis of the embossing wheel on which it is mounted.

36. The embossing machine of claim 35, further comprising second means for rotating each of said levers from said second position to said first position whereby the mold body may move radially inwardly toward the axis of the embossing wheel on which it is mounted.

37. The embossing machine of claim 36, wherein said second means for rotating comprises a cam surface impacted by each of said levers in said second position.

38. The embossing machine of claim 31, wherein each of said cam means is mounted for movement parallel to said parallel axes from a first position to a second position for causing, when in said second position, said selected matching pair of embossing molds to extend radially outwardly from said embossing wheels.

39. The embossing machine of claim 38, further comprising ramp means mounted below each of said embossing wheels for slidably contacting said cam means to move said cam means from said first position to said second position.

40. The embossing machine of claim 38, wherein said cam means comprises
first means having a shape relatively thin at its upper end and relatively thick at its lower end, and
second means depending from said first means and free to pivot through arcs along radii of said wheels so that the lower ends thereof may move between a first inward position along said radii and a second position along said radii.

41. The embossing machine of claim 40, further comprising ramp means mounted below each of said embossing wheels for slidably contacting the lower ends of said second means when said second means are in said first inward position.

42. The embossing machine of claim 41, further comprising selection means for selectively moving said second means from said second outward position to said first inward postion.

43. The embossing machine of claim 42, wherein said selection means comprises impeller means for rotating from a rest position to an impact position for moving said second means to said first inward position, and, motor means for rotating said impeller means.

44. In a machine for embossing characters in flexible sheets, the combination comprising, base place means to which is attached first and second upwardly extending cylindrical shafts, said shafts having constantly spaced adjacent parallel axes, first and second embossing wheels respectively mounted for rotation on said shafts, each of said wheels including radially extending cavities located abouts its periphery, said peripheries spaced apart a distance greater than the thickness of said flexible sheets, first and second meshing ring gears respectively mounted about said first and second embossing wheels, means for constantly rotating said first and second embossing wheels, first and second corresponding sets of embossing molds bodies, each body bearing on its outer face the representation of a character for embossing and mounted in one of said cavities for selective radial movement from a first position relatively toward the axis of the embossing wheel on which it is mounted, to a second position extending radially outwardly from said wheel, and, cam means for moving a selected matching pair of said mold bodies, one of said pair from each of said first and second sets, along radii of said wheels during rotation of said wheels outwardly from said embossing wheels, whereby a character borne by the selected matching pair of embossing mold bodies is embossed in a flexible sheet placed between the embossing wheels.

45. The embossing machine of claim 44, wherein said means for constantly rotating said first and second embossing wheels comprises an electric motor having a gear on its armature shaft meshing with one of said ring gears.

46. The embossing machine of claim 44, further comprising means for transporting a flexible sheet to be embossed along perpendicular axes between said embossing wheels.

47. The embossing machine of claim 44, further comprising means for sensing the angular position of said embossing wheels and developing an electrical output proportional thereto, means for generating a unique electrical output determined by the character to be embossed, means for generating a selection signal when a predetermined relationship between the unique electrical output and the output proportional to the angular position of said embossing wheels is found to exist, and, means connected to receive said selection signal for causing said cam means to move said matching pair of mold bodies.

48. The embossing machine of claim 47, wherein said means for sensing the angular position of said embossing wheels comprises means for generating an electrical pulse upon the passage of each tooth of a toothed disc rotating with said embossing wheels, and digital counter means for generating a binary number corresponding to the number of generated pulses.

49. The embossing machine of claim 47, wherein said means for generating a unique electrical output comprises a manual keyboard having one electrical output line for each different character which may be embossed.

50. The embossing machine of claim 49, wherein said means for generating a selection signal comprises a plurality of decoder modules, each decoder module for generating an output if a predetermined binary number is found to have been generated by said digital counter means.

51. In a machine for embossing characters in flexible sheets, the combination comprising, a first embossing wheel, a plurality of first embossing molds mounted around the periphery of said first embossing wheel, each of said embossing molds movable along a different radius of said first embossing wheel to extend outwardly from said wheel in a radial direction, each embossing mold bearing a single male character for embossing, a second embossing wheel, a plurality of second embossing molds mounted around the periphery of said second embossing wheel, each of said embossing molds movable along a different radius of said second embossing wheel to extend outwardly from said wheel in a radial direction, each embossing mold bearing a single female character matching one of said male characters, said peripheries spaced apart a distance greater than the thickness of said flexible sheets, means for constantly rotating said first and second embossing wheels about constantly spaced adjacent parallel axes, and, means for selectively moving a selected matching pair of said first and second embossing molds outwardly from said first and second embossing wheels to emboss the character borne by the selected embossing molds in a flexible sheet placed between the embossing wheels.

52. The embossing machine of claim 51, further comrpsing machine base means with first and second upwardly extending cylindrical shafts with said first and second embossing wheels respectively rotatable mounted thereon.

53. The embossing machine of claim 52, further comprising a ring gear mounted about the periphery of each of said embossing wheels, each of said gears in mesh with the other, and, wherein said means for constantly rotating comprises an electric motor having a gear on its armature shaft in mesh with one of said ring gears.

54. The embossing machine of claim 51, wherein said first and second embossing wheels include cavities equally spaced around their peripheries, with one embossing mold mounted for radial movement relative to the embossing wheel in which it is mounted in each of said cavities.

55. The embossing machine of claim 54, wherein said cavities comprise rectangular holes and each of said embossing molds comprise rectangular bodies.

56. The embossing machine of claim 51, in which said means for selectively moving comprises cam means, with a single cam means rotatably mounted about a radius of the wheel to which it is attached from a first position away from an embossing mold to a second position in contact with said mold.

57. The embossing machine of claim 56, further comprising means for rotating said cam means from said second position to said first position.

58. The embossing machine of claim 51, in which said means for selectively moving comprises cam means mounted adjacent to the inward face of said embossing molds mounted for movement parallel to said parallel axes from a first position to a second position for causing said selected matching pair of embossing molds to extend radially outwardly from said embossing wheels.

59. The embossing machine of claim 58, further comprising ramp means mounted below each of said embossing wheels for slidably contacting said cam means to move said cam means from said first position to said second position.

60. The embossing machine of claim 58, wherein said cam means comprises first means having a shape relatively thin at its upper end and relatively thick at its lower end mounted for slidable contact with the said inward face of said embossing molds, and second means depending from said first means and free to pivot through arcs along radii of said wheels so that the lower ends thereof may move between a first inward position along said radii and a second outward position along said radii.

61. The embossing machine of claim 60, further comprising ramp means mounted below each of said embossing wheels for slidably contacting the lower ends of said second means when said second means are in said first inward position.

62. The embossing machine of claim 51, further comprising means for sensing the angular position of said embossing wheels and developing an electrical position output determined thereby, means for generating a unique electrical output corresponding to the character to be embossed, means for determining whether a predetermined relationship exists between said electrical position output and said unique electrical output and for generating a selection signal if said relationship is found, and, means for causing operation of said means for selectively moving in response to said selection signal.

63. The embossing machine of claim 62, wherein said means for sensing the angular position of said embossing wheels comprises, means for generating electrical pulses having a frequency proportional to the speed of rotation of said embossing wheels, and, digital counter means for generating a binary number to indicate the number of electrical pulses counted.

64. The embossing machine of claim 62, wherein said means for generating a unique electrical output comprises a manual keyboard having one output line for each operable key.

65. The embossing machine of claim 62, wherein said causing means comprises an electrical solenoid.

66. In a machine for embossing characters in flexible sheets, the combination comprising, first and second disks mounted for constant synchronous co-planar rotation about constantly spaced adjacent parallel axes, embossing molds mounted about the peripheries of said disks for movement along radii of said disks during rotation of said disks from a first position relatively toward the axis of the disk in which they are mounted to a second position radially extended from the disk in which they are mounted, said peripheries spaced apart a distance greater than the thickness of said flexible sheets.

67. The embossing machine of claim 66, further comprising means for rotating said first and second disks.

68. The embossing machine of claim 66, further comprising ring gears mounted in mesh about the first and second disks, and, motor means for rotating said disks.

69. The embossing machine of claim 66, wherein, said first and second disks are provided with radially extending cavities equally spaced along their peripheries, and said embossing mold means comprises a plurality of mold bodies, each mold body mounted for radial movement within one of said cavities.

70. The embossing machine of claim 66, further comprising means for selectively moving selected ones of said embossing mold means from said first position to said second position.

71. The embossing machine of claim 70, wherein said means for selectively moving comprises cam means mounted for rotation about a radius of the disk on which it is mounted from a first position away from said embossing mold means to a second position in contact with said embossing mold means.

72. The embossing machine of claim 70, wherein said means for selectively moving comprises cam means mounted adjacent to said embossing mold means mounted for movement parallel to said parallel axes from a first position to a second position for causing said selected matching pair of embossing molds to extend radially outwardly from said embossing wheels.

73. The embossing machine of claim 72, wherein said cam means comprises first means having a shape relatively thin at its upper end and relatively thick at its lower end mounted for slidable contact with said embossing molds, and second means depending from said first means and free to pivot through arcs along radii of said wheels so that the lower ends thereof may move between a first inward position along said radii and a second outward position along said radii.

74. The embossing machine of claim 73, further comprising ramp means mounted below each of said disks for slidably contacting the lower ends of said second means when said second means are in said first inward position.

75. The embossing machine of claim 66, further comprising a machine base plate to which is attached first and second upwardly extending cylindrical shaft means for rotatably mounting said first and second disks.

76. The embossing machine of claim 75, wherein, said first and second disks are provided with radially extending cavities spaced equally along their peripheries, and, said embossing mold means comprises a plurality of mold bodies, each mold body mounted for radial movement within one of said cavities.

77. The embossing machine of claim 66, further comprising, means for sensing the angular position of said disks and developing an electrical output proportional thereto, means for generating a unique electrical output determined by the character to be embossed, means for generating a selection signal when a predetermined relationship between the unique electrical output and the output proportional to the angular position of said disks is found to exist, and, means connected to receive said selection signal for causing said embossing mold means to move from said first position to said second position.

78. The embossing machine of claim 77, wherein said means for sensing comprises, means for generating electrical pulses having a frequency proportional to the speed of rotation of said disks, and, digital counter means for generating a binary number corresponding to the number of received electrical pulses.

79. The embossing machine of claim 78, wherein said means for generating a selection signal comprises a plurality of decoder modules, each decoder module for generating an output if a pre-determined binary number is found to have been generated by said digital counter means.

80. The embossing machine of claim 79, wherein said means for generating a selection signal comprises a plurality of AND gates, each AND gate connected to receive as its input the output of one of said decoder modules and the unique electrical output determined by the character to be embossed.

81. The embossing machine of claim 77, wherein said means for generating a unique electrical output comprises a manual keyboard having one electrical output line for each different character which may be embossed.

82. The embossing machine of claim 77, wherein said means connected to receive said selection signal comprises, cam means mounted between each of the embossing mold means and the axis of said disks, and, solenoid means energizable by said selection signal for causing said cam means to move said embossing mold means to said second position.

83. The embossing machine of claim 82, wherein said cam means comprises a plurality of levers each mounted for rotation about a radius of said disks.

84. The embossing machine of claim 66, further comprising means for transporting a flexible sheet to be embossed along perpendicular axes between said disks.

85. In a method of embossing characters in flexible sheets, wherein embossing molds are mounted for selective radial movement about the peripheries of first and second embossing wheels, said peripheries spaced apart a distance greater than the thickness of said flexible sheets, the steps of, constantly rotating the first and second embossing wheels in the same plane about constantly spaced parallel adjacent axes and at a distance between their adjacent edges slightly greater than the thickness of said flexible sheets to be embossed, placing a flexible sheet to be embossed in the bite of the two rotating embossing wheels, and, radially extending one embossing mold from corresponding angular positions of each of said embossing wheels so that a character carried by said extended embossing molds if embossed in said flexible sheet in a rolling-squeezing process.

86. The method of claim 85, further comprising the steps of electronically sensing the instantaneous angular positions of said first and second embossing wheels and generating an electrical position signal corresponding thereto, generating a unique electronic signal determined by the character to be embossed, and performing said extending step if a predetermined relationship is found between said electrical position signal and said unique electrical signals.

87. The method of claim 86, wherein the step of electronically sensing comprises the steps of, generating electrical pulses proportional to the speed of revolution of said embossing wheels, and, counting said pulses for each resolution of said wheels and generating binary number corresponding thereto.

88. The method of claim 86, wherein the step of generating a unique electrical signal comprises the step of manual operation of a keyboard to indicate the character to be embossed.

89. In a machine for embossing characters in flexible sheets, the combination comprising, first and second embossing wheels mounted for coplanar synchronous rotation about constantly spaced adjacent parallel axes, first and second corresponding sets of embossing molds respectively mounted about the peripheries of said first and second embossing wheels, which peripheries are spaced apart a distance greater than the thickness of said flexible sheets, means for moving during rotation of said embossing wheels a selected matching pair of embossing molds, one of said pair from each of said first and second sets, along radii of said wheels to extend radially outwardly from said embossing wheels, said means comprising cam means mounted adjacent to the inward face of said embossing molds mounted for movement parallel to said parallel axes from a first position to a second position for causing said selected matching pair of embossing molds to extend radially outwardly from said embossing wheels, whereby a character borne by the selected matching pair of embossing molds is embossed in a flexible sheet placed between the embossing wheels.

90. The embossing machine of claim 89, further comprising ramp means mounted below each of said embossing wheels for slidably contacting said cam means to move said cam means from said first position to said second position.

91. The embossing machine of claim 90, wherein said cam means comprises first means having a shape relatively thin at its upper end and relatively thick at its lower end mounted for slidable contact with the said inward face of said embossing molds, and second means depending from said first means and free to pivot through arcs along radii of said wheels so that the lower ends thereof may move between a first inward position along said radii and a second outward position along said radii.

92. The embossing machine of claim 91, further comprising selection means for selectively moving said second means from said second outward position to said first inward position.

* * * * *